US005223385A

United States Patent [19]

Hasebe

[11] Patent Number: 5,223,385

[45] Date of Patent: * Jun. 29, 1993

[54] SILVER HALIDE COLOR PHOTOGRAPHIC MATERIAL CONTAINING A PHENOL CYAN COUPLER AND METHOD OF IMAGE

[75] Inventor: Kazunori Hasebe, Kanagawa, Japan

[73] Assignee: Fuji Photo Film Co., Ltd., Kanagawa, Japan

[ * ] Notice: The portion of the term of this patent subsequent to Sep. 10, 2008 has been disclaimed.

[21] Appl. No.: 294,710

[22] Filed: Jan. 9, 1989

[30] Foreign Application Priority Data

Jan. 8, 1988 [JP] Japan ..... 63-1251

[51] Int. Cl.[5] ..... G03C 1/38; G03C 7/34; G03C 7/388

[52] U.S. Cl. ..... 430/546; 430/552; 430/553; 430/567; 430/584; 430/595

[58] Field of Search ..... 430/546, 552, 553, 567, 430/584, 595

[56] References Cited

U.S. PATENT DOCUMENTS

| | | | |
|---|---|---|---|
| 4,368,258 | 1/1983 | Fujiwhara et al. | 430/546 |
| 4,564,591 | 1/1986 | Tanaka et al. | 430/567 |
| 4,590,155 | 5/1986 | Klotzer | 430/567 |
| 4,770,987 | 9/1988 | Takahashi et al. | 430/607 |
| 4,839,270 | 6/1989 | Kajima et al. | 430/583 |
| 4,857,449 | 8/1989 | Ogawa et al. | 430/550 |
| 4,863,836 | 9/1989 | Ishikawa et al. | 430/583 |
| 4,892,807 | 1/1990 | Hirabayashi et al. | 430/505 |
| 4,946,770 | 8/1990 | Takahashi et al. | 430/545 |
| 5,047,314 | 9/1991 | Sakai et al. | 430/505 |
| 5,077,188 | 12/1991 | Tanji et al. | 430/546 |
| 5,082,764 | 1/1992 | Takahashi | 430/546 |

FOREIGN PATENT DOCUMENTS

| | | | |
|---|---|---|---|
| 0256531 | 2/1988 | European Pat. Off. | 430/553 |

*Primary Examiner*—Lee C. Wright
*Attorney, Agent, or Firm*—Sughrue, Mion, Zinn, Macpeak & Seas

[57] ABSTRACT

A silver halide color photographic material comprises at least one silver halide emulsion layer containing a substantially iodide free silver chlorobromide or silver chloride grain of which the silver chloride content is at least 90 mol. % and a color coupler. The color coupler is at least one compound represented by formula (I) or (II). The coupler is dispersed in the emulsion layer, as a dispersion of a fine lipophilic particle obtained by emulsification and dispersion of a solution obtained by dissolution of the coupler together with at least one homopolymer or copolymer which is insoluble in water and soluble in an organic solvent and a high boiling point organic solvent:

(I)

(II)

$R_1$, $R_4$, and $R_5$ represent aliphatic, aromatic or heterocyclic groups; $R_3$ and $R_6$ each represents a hydrogen atom, a halogen atom, an aliphatic group, an aromatic group or an acylamino group, or $R_6$ represents a group of non-metal atoms required to form, together with $R_5$, a five or six membered nitrogen containing ring; $R_2$ represents an aliphatic group; $Y_1$ and $Y_2$ each represents a hydrogen atom or a group which can be eliminated during a coupling reaction with the oxidized form of a developing agent. l represents the integer 0 or 1. Polymeric couplers consisting of dimers or greater units can be formed via one group from among $R_2$, $R_3$, $Y_1$ or one group among $R_5$, $R_6$, and $Y_2$.

8 Claims, No Drawings

SILVER HALIDE COLOR PHOTOGRAPHIC MATERIAL CONTAINING A PHENOL CYAN COUPLER AND METHOD OF IMAGE

FIELD OF THE INVENTION

This invention concerns photosensitive materials which have a high speed, which are stable and which can be processed rapidly. More precisely, the invention concerns silver halide color photographic materials comprising silver chloride or high silver chloride content emulsions whose performance characteristics are relatively insensitive to variations in the manufacturing process, especially with regard to the variation in time between preparation of the emulsion and subsequent coating and with regard to storage of the photographic material and which can be mass produced in a stable manner, and a method of rapid processing of these materials which gives rise to less pollution.

BACKGROUND OF THE INVENTION

Simpler and more rapid color development processing, high picture quality and uniformity of finish are desirable characteristics of color photosensitive materials.

In order to speed up color development processing it is necessary to speed up two types of reactions including the reaction between the silver halide grains and the color developer and the subsequent reaction which takes place between the color couplers and the oxidation products of the developing agents thus formed.

In the reaction between silver halide grains and the color developer, it is known that the form, size and composition of the photosensitive silver halide grains used have a considerable effect on the rate of development.

It is also known in this connection that silver chloride grains and grains which have a high silver chloride content in particular are useful for speeding up development.

The coupling activity of the coupler is a dominant factor in the development rate, especially in cases where benzyl alcohol is not used in the developer due to environmental concerns.

Many attempts have been made recently to increase the rate of development using high silver chloride content emulsions in color development baths which do not contain benzyl alcohol.

However, although it is possible to increase the rate of development using these techniques, few proposals have been made in connection with the provision of photosensitive materials having high silver chloride content emulsions to be manufactured on a commercial basis and in a stable manner. Current techniques are not be adequate in this regard.

High silver chloride emulsions are very effective for rapid processing, especially with development baths which do not contain benzyl alcohol, but mass production in a stable manner is very difficult.

This difficulty in manufacturing is explained as follows: such emulsion coating liquids are prepared by mixing dispersions of color couplers in high boiling point organic solvents with spectrally sensitized high silver chloride content emulsions. A certain time elapses before these mixtures are coated onto the support. It is difficult to maintain a constant lapse time between preparation of the emulsion coating liquid and subsequent coating on the support in the type of facility normally used for the mass production of photographic materials. This variation in coating time is related to a fluctuation in photographic performance.

Fluctuation in photographic performance occurs when emulsion coating liquids are left to stand prior to coating because adsorption of the spectrally sensitizing dyes on the high silver chloride content emulsion is affected by the dispersion of the color coupler and the high boiling point organic solvent mixture. High silver chlolide content emulsions have a much weaker affinity for spectrally sensitizing dyes as compared to emulsions which have a high silver bromide content.

Consequently, the use of spectrally sensitizing dyes which are more strongly adsorbed on high silver chloride emulsion grains has been suggested as a means of resolving the above problems. These techniques have been disclosed in practical terms in JP-A-59-166955 and JP-A-59-214030 for example (the "JP-A" as used herein signifies a published, unexamined Japanese patent application).

However, the selection of sensitizing dyes which do not result in fluctuation in photographic performance, even in the mass production of photosensitive materials with high silver chloride content emulsions, is quite difficult for the reasons described below.

Spectrally sensitizing dyes affect many aspects of photographic performance including exposure luminance dependence of the photographic emulsion speed, latent image storage properties and stability on storage of the product for prolonged periods of time in addition to basic intensity and wavelength band of the spectral sensitization. Sensitizing dyes which have adequate adhesion on high silver chloride grains do not always meet all of the above performance requirements and indeed, such cases are in fact rather rare.

Fluctuation in performance arising from variation in coating time of a mixture of a spectrally sensitized high silver chloride content emulsion and a mixed dispersion of color couplers and high boiling point organic solvent strongly affects photographic properties.

Photosensitive materials which exhibit a dependency of the type referred to above are generally susceptible to similar fluctuations in performance once the samples have been coated.

SUMMARY OF THE INVENTION

An objective of the present invention is to provide stable, high silver chloride content photosensitive materials amenable to mass production methods wherein the photographic properties of said material are relatively insensitive to variations in coating time (e.g., time between preparation of the emulsion and subsequent coating) and to provide a method of rapid processing of stable and uniform quality.

The objectives of the present invention are realized:

(1) with silver halide color photographic materials comprising a support having thereon at least one silver halide emulsion layer containing a substantially iodide free silver chlorobromide or silver chloride grain of which the silver chloride content is at least 90 mol. % and a color coupler, wherein the color coupler which is contained in the emulsion layer is at least one type of a compound represented by general formula (I) and/or (II) below, and wherein the coupler is dispersed in the emulsion layer as a mixed dispersion of a fine lipophilic particle obtained by emulsification and dispersion of a mixed solution obtained by dissolution together with at least one type of homopolymer or copolymer which is insoluble in water and soluble in an organic solvent.

(2) with silver halide color photographic material as in (1), wherein the silver halide grains contained in the emulsion layer of said photographic material are spectrally sensitized with at least one type of sensitizing dye represented by the general formulae (III), (IV), or (V) below; and wherein said mixed dispersion consists of said color coupler, a low boiling point or water soluble organic solvent and at least one type of water insoluble and organic solvent soluble homo or copolymer; and wherein the mixed dispersion is mixed with the silver halide grain after removing the low boiling point or water soluble organic solvent in the emulsification and dispersion process until the ratio (by weight) with respect to the coupler becomes not more than ½ to prepare a coating liquid.

(3) with photosensitive material as disclosed in (1) or (2) above wherein the silver halide emulsion grains contained in said emulsion layer have a silver bromide rich phase either at the surface of or within said grains.

(4) with a method of forming a color photographic image comprising the steps of; developing a silver halide color photographic material for a time not to exceed 60 seconds in a color development bath essentially free of benzyl alcohol, bromide ion and sulfite ion using the aforementioned photosensitive materials disclosed in (1), (2) or (3) above.

General Formula (I)

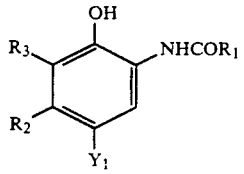

General Formula (II)

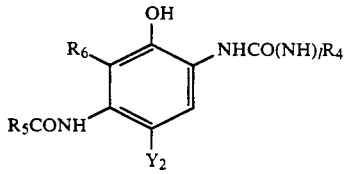

In general formulae (I) and (II), $R_1$, $R_4$ and $R_5$ represent substituted or unsubstituted aliphatic, aromatic or heterocyclic groups, $R_3$ and $R_6$ represent hydrogen atoms, halogen atoms, aliphatic groups, aromatic groups or acylamino groups and $R_1$ may represent a group of non-metal atoms required to form, together with $R_5$, a five or six membered nitrogen containing ring. $R_2$ represents an aliphatic group which may be substituted. $Y_1$ and $Y_2$ represent hydrogen atoms or groups which can be eliminated during a coupling reaction with the oxidized form of a developing agent, and l represents the integer 0 or 1. Polymeric couplers consisting of dimers or greater units can be formed via one group from among $R_2$, $R_3$ and $Y_1$ or one group among $R_5$, $R_6$ and $Y_2$.

General Formula (III)

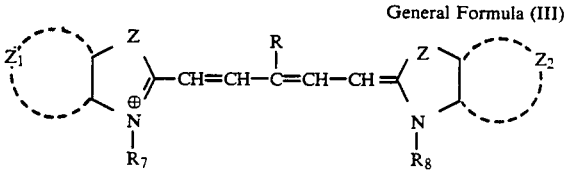

$(X^{\ominus})_{l-1}$

-continued

General Formula (IV)

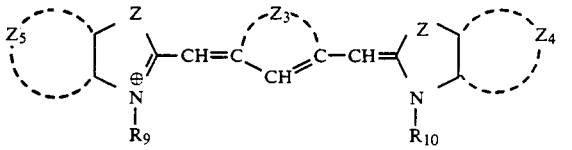

In general formula (III) and (IV), R represents a hydrogen atom or an alkyl group, $R_7$ to $R_{10}$ each represents an alkyl group or an aryl group, and $Z_1$, $Z_2$, $Z_4$ and $Z_5$ each represents a group of atoms required to form a benzene ring or a naphthalene ring which is condensed with the thiazole ring or the selenazole ring, $Z_3$ represents a group of carbon atoms which is required to form a six membered ring, l represents 1 or 2, and Z represents a sulfur atom or a selenium atom. The two Z atoms may be the same or different. $X^{\ominus}$ represents an anion.

General Formula (V)

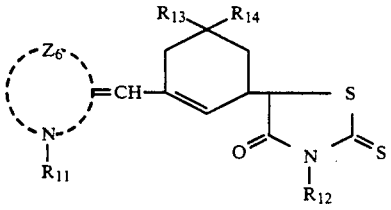

In general formula (V), $R_{11}$ and $R_{12}$ each represents an alkyl group, aryl group or an allyl group, and at least one of $R_{11}$ and $R_{12}$ represents an alkyl group which contains a sulfo group or an alkyl group which contains a carboxyl group. $R_{13}$ and $R_{14}$ each represents alkyl groups. $Z_6$ represents a group of non-metal atoms which is required to form a five or six membered nitrogen containing heterocyclic ring.

The preferred water insoluble and organic solvent soluble polymers for use in this invention are non color forming polymers and preferably have a glass transition temperature of at least 60° C., and more preferably they have a glass transition temperature of at least 90° C.

DETAILED DESCRIPTION OF THE INVENTION

Preferred polymer structures are indicated as follows:

1) Water insoluble, organic solvent soluble homopolymers or copolymers in which the repeating unit has a

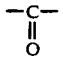

group in the main chain or in a side chain.

Preferred polymers are those having relative fluorescent quantum yield, K-value, of 0.2 or more, preferably 0.25 or more, and more preferably 0.3 or more. The polymers having higher K value are more preferred.

The K-value is a relative fluorescent quantum yield, in polymers, of compound A having the following structure, compound A being one of the dyes which are often used as fluorescent probes.

The K-value is define by the following equation.

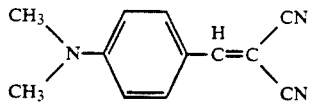

wherein $\Phi_a$ and $\Phi_b$ are the fluorescent quantum yields of compound A in polymers a and b, respectively, and deterimined in accordance with the method described, for example, in *Macromolecules*, 14, 587 (1981). Specifically, the K-value was caleulated using $\Phi_a$ and $\Phi_b$, which were obtained by measuring at room teruperature using thin films of polymers containing compound A at a concentration of 0.5 m mol/kg (note: The thin films were spin-coated on a slide glass in such a thickness that the absorbane of compound A at λmax was from 0.05–0.1.) In the present invention, the K-value specified above was that obtained when poly (methyl methacrylate) with a number average molecular weight of 20,000 was used as polymer b.

2) Water insoluble, organic solvent soluble homopolymers or copolymers in which the repeating unit has a

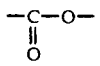

group in the main chain or in a side chain.

3) Water insoluble, organic solvent soluble homopolymers or copolymers in which the repeating unit has a

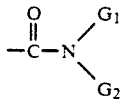

group in the main chain or in a side chain (where $G_1$ and $G_2$ each represents a hydrogen atom, or a substituted or unsubstituted alkyl or aryl group, but where both $G_1$ and $G_2$ cannot be hydrogen atoms at the same time).

More desirably, are polymers as described in (3) above where one of $G_1$ and $G_2$ is a hydrogen atom and the other is a substituted or unsubstituted alkyl or aryl group which has from 3 to 12 carbon atoms.

Actual examples of polymers which can be used in the invention are described below, but the invention is not limited to these examples.

(A) Vinyl Polymers

Monomers which can be used to form vinyl polymers of this invention include acrylic acid esters, which include methyl acrylate, ethyl acrylate, n-propyl acrylate, iso-propyl acrylate, n-butyl acrylate, iso-butyl arcylate, sec-butyl acrylate, tert-butyl acrylate, amyl acrylate, hexyl acrylate, 2-ethyl hexyl acrylate, octyl acrylate, tert-octylacrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzylacrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxyethyl acrylate, 2-butoxyethyl acrylate, 2- (2-methoxyethoxy)ethylacrylate, 2-(2-butoxyethoxy)ethyl acrylate, ω-methoxypolyethyleneglycol acrylate (number of mols added n=9), 1-bromo-2-methoxyethyl acrylate, 1,1-dichloro-2-ethoxyethyl acrylate. etc. Moreover, the monomers, etc. indicated below can also be used.

Methacrylic acid esters: Examples include methyl methacrylate, ethyl methacrylate, n-propyl methacrylate, iso-propyl methacrylate, n-butyl methacrylate, iso-butyl methacrylate, sec-butyl methacrylate, tert-butyl methacrylate, amyl methacrylate, hexyl methacrylate, cyclohexyl methacrylae, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethyleneglycol monomethacrylate, dipropyleneglycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethyleneglycol methacrylate (number of mols added n=6), allyl methacrylate, methacrylic acid dimethylaminoethylmethyl chloride etc.

Vinyl esters: Actual examples include vinyl acetate, vinyl propionate, vinyl butyrate, vinyl iso-butyrate, vinyl caproate, vinyl chloroacetate, vinyl methoxyacetate, vinyl phenylacetate, vinyl benzoate, vinyl salicylate etc.

Acrylamides: For example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethyl acrylamide, dimethylaminoethylacrylamide, phenylacrylamide, dimethylacrylamide, diethylacrylamide, β-cyanoethylacrylamide, N-(2-acetoacetoxyethyl)acrylamide, di-acetoneacrylamide, tert-octylacrylamide etc.

Methacrylamides: For example methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, N-(2-acetoacetoxyethyl)methacrylamide etc.

Olefins: For example dicyclopentadiene, ethylene, propylene, 1-butene, 1-pentene, vinyl chloride, vinylidene chloride, isoprene, chloroprene, butadiene, 2,3-dimethylbutadiene etc.; styrenes, for example styrene, methylstyrene, dimethylstryrene, trimethylstyrene, ethylstyrene, iso-propylstyrene, chloromethylstyrene, methoxystyrene, acetoxystyrene, chlorostyrene, dichlorostyrene, bromostyrene, methyl vinylbenzoate etc.

Vinyl ethers: For example methyl vinyl ether, butyl vinyl ether, benzyl vinyl ether, methoxyethyl vinyl ether, dimethylaminoethyl vinyl ether etc.

Other compounds which can be used to form vinyl polymers of this invention include, for example butyl crotonate, hexyl crotonate, dimethyl itaconate, butyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalononitrile, vinylidene etc.

Two or more of the monomers (i.e., above identified monomers) which can be used in polymers of this invention can be used as co-monomers for various purposes (for example for improving solubility to an organic solvent). Furthermore, monomers which have acid groups, such as those indicated below, can also be used as co-monomers for the adjustment of coloring properties and solubility provided that the copolymer remains insoluble in water.

These acid comonomers include: Acrylic acid; methacrylic acid; itaconic acid; maleic acid; monoalkyl itaconates, for example monomethyl itaconate, monoethyl itaconate, monobutyl itaconate etc.; monoalkyl maleates, for example monomethyl maleate, monoethyl maleate; monobutyl maleate etc.; citraconic acid; styrenesulfonic acid; vinylbenzenesulfonic acid; vinylsulfonic acid, acryloyloxyalkylsulfonic acids, for example acryloyloxymethylsulfonic acid; acryloyloxyethylsulfonic acid, acryloyloxypropylsulfonic acid etc.; methacryloyloxyalkylsulfonic acids, for example methacryloyloxymethylsulfonic acid, methacryloyloxyethylsulfonic acid, methacryloyloxypropylsulfonic acid etc.; acrylamidoalkylsulfonic acids, for example 2-acrylamido-2-methylethanesulfonic acid, 2-acrylamido-2-methylpropanesulfonic acid, 2-acrylamido-2-methylbutanesulfonic acid etc.; methacrylamidoalkylsulfonic acids, for example 2-methacrylamido-2-methylethanesulfonic acid, 2-methacrylamido-2-methylpropanesulfonic acid, 2-methacrylamido-2-methylbutanesulfonic acid etc.; and the alkali metal (for example sodium, potassium etc.) or ammonium ion salts of these acids.

In cases where a hydrophilic monomer (signifing a monomer which forms a water soluble homopolymer) is used as a co-monomer with the vinyl monomers indicated here or other vinyl monomers which can be used in the invention. No particular limitation is imposed on the proportion of hydrophilic monomer in the copolymer provided that the copolymer does not become water soluble, but normally such monomers are used in an amount not exceeding 40 mol. %, preferably not exceeding 20 mol. % and, more desirably, in an amount not exceeding 10 mol. %. Furthermore, in cases where the hydrophilic co-monomer is copolymerized with a monomer of this invention which has acid groups, the proportion in the copolymer of the co-monomer which has acid groups is normally not more than 20 mol. %, and preferably not more than 10 mol. %, from the point of view of the image storage properties as previously described, and the absence of copolymers of this type is most desirable.

The monomers of this invention in the polymer are preferably methacrylate based, acrylate based or methacrylamide based monomers. The acrylate and methacrylate based monomers are especially desirable.

(B) Polymers Formed by Condensation and Polyaddition Reactions

Polyesters formed from polyhydric alcohols and polybasic acids and polyamides formed from diamines and dibasic acids, and from ω-amino-ω'-carboxylic acids, are generally known as condesnsation polymers. Polymers such as the polyurthanes which are formed from diisocyanates and dihydric alcohols are known as polymers which have been formed by means of a polyaddition reaction.

Glycols which have an OH—$R_2$—OH structure (where $R_2$ is a hydrocarbon chain, typically an aliphatic hydrocarbon chain having from 2 to about 12 carbon atoms) and polyalkyleneglycols are effective as polyhydric alcohols. Acids which have an HOOC—$R_2$.COOH structure (where $R_2$ represents a single, bond or a hydrocarbon chain having from 1 to about 12 carbon atoms) are effective as polybasic acids.

Examples of polyhydric alcohols for use in the present invention include ethyleneglycol, diethyleneglycol, triethyleneglycol, 1,2-propyleneglycol, 1,3-propylene glycol, trimethylolpropane, 1,4-butanediol, isobutylenediol, 1,5-pentanediol, neopentylglycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerine, diglycerine, tri-glycerine, 1-methylglycerine, erythritol, mannitol, sorbitol etc.

Examples of polybasic acids for use in the present invention include oxalic acid, succinic acid, glutaric acid, adipic acid, pimelic acid, azelaic acid, sebacic acid, nonanedicarboxylic acid, decanedicarboxylic acid, undecanedicarboxylic acid, dedecanedicarboxylic acid, fumaric acid, maleic acid, itaconic acid, citraconic acid, phthalic acid, isophthalic acid, terephthalic acid, tetrachlorophthalic acid, metaconic acid, isohymelic acid, cyclopendadiene-maleic anhydride adduct, rosin-malic anhydride adduct, etc.

Examples of diamines for use in the present invention include hydrazine, methylenediamine, ethylenediamine, trimethylenediamine, tetramethylenediamine, hexamethylenediamine, dodecamethylenediamine, 1,4-diaminocyclohexane, 1,4-diaminomethylcyclohexane, o-aminoaniline, p-aminoaniline, 1,4-diaminomethylbenzene and di(4-aminophenyl)ether, etc.

Examples of ω-amino-ω-carboxylic acids for use in the present invention include glycine, β-alanine, 3-aminopropanoic acid, 4-aminobutanoic acid, 5-aminopentanoic acid, 11-aminododecanoic acid, 4-aminobenzoic acid, 4-(2-aminoethyl)benzoic acid and 4-(4-aminophenyl)-butanoic acid, etc.

Examples of diisocyanates for use in the present invention include ethylenediisocyanate, hexamethylenediisocyanate, m-phenylendiisocyanate, p-phenylenediisocyanate, p-xylenediisocyanate and 1,5-naphthyldiisocyanate, etc.

(C) Others

Polyesters and polyamides which can be obtained by ring opening polymerization:

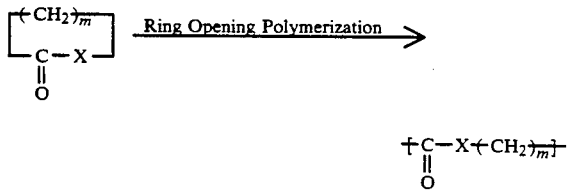

X in this equation represents an —O— group or an —NH— group and m represents an integer of value 4 to 7. The —$CH_2$— groups may be branched.

Monomers of this type include β-propiolactone, ε-caprolactone, dimethylpropiolactone, α-pyrrolidone, α-piperidone, ε-caprolactam and α-methyl-ε-caprolactam etc.

Two or more of any type of polymer of the present invention can be used conjointly.

The molecular weight and degree of polymerization of the polymer of this invention do not have an especially marked effect on the effectiveness of the invention. However, more time is required to dissolve a polymer in an auxiliary solvent as the molecular weight increases, and the solution viscosity also rises so that emulsification and dispersion become more difficult and coarse particles are formed thereby adversely affecting coloring properties. Additional problems are also likely to arise as a result of poor coating properties. Larger quantities of auxiliary solvents can be used to lower the viscosity but this introduces new process steps. From this point of view, the viscosity observed on dissolving 30 grams of polymer in 100 cc of auxiliary solvent is preferably not more than 5000 cps, and preferably not more than 2000 cps. The molecular weight of the polymers which can be used in the present invention is preferably not more than 150,000, and more preferably not more than 100,000.

A "water insoluble polymer" in this invention is a polymer having a solubility of not more than 3 grams, and preferably not more than 1 gram, in 100 grams of distilled water at 20° C.

The relative quantity of the polymer of the present invention with the auxiliary solvent varies according to the type of polymer employed, and its solubility in the auxiliary solvent, the degree of polymerization and the solubility of the coupler. Normally, the amount of auxiliary solvent used is that amount required to allow the solution formed by dissolving at least the coupler, the high boiling point coupler solvent and the polymer in the auxiliary solvent is sufficiently low to allow the solution to be dispersed easily in water or in an aqueous hydrophilic colloid solution. The solution viscosity increases as the degree of polymerization of the polymer increases. Thus it is difficult to state a fixed rule for the proportion of polymer in the auxiliary solvent. Normally, however, the proportions are preferably within the range of from about 1:1 to 1:50 (polymer to solvent by weight). The proportion (by weight) of the polymer of this invention with respect to the coupler is preferably from 1:20 to 20:1, and more preferably from 1:10 to 10:1.

Examples of polymers which can be used in the present invention are described below, but the invention is not limited to these examples.

| Example | Type of Polymer |
|---|---|
| P-1) | Poly(vinyl acetate) |
| P-2) | Poly(vinyl propionate) |
| P-3) | Poly(methyl methacrylate) |
| P-4) | Poly(ethyl methacrylate) |
| P-5) | Poly(ethyl acrylate) |
| P-6) | Vinyl acetate/vinyl alcohol copolymer (95:5) |
| P-7) | Poly(n-butyl acrylate) |
| P-8) | Poly(n-butyl methacrylate) |
| P-9) | Poly(iso-butyl methacrylate) |
| P-10) | Poly(iso-butyl methacrylate) |
| P-11) | Poly(decyl methacrylate) |
| P-12) | n-Butyl acrylate/acrylamide copolymer (95:5) |
| P-13) | Poly(methyl chloroacrylate) |
| P-14) | 1-4-Butanediol/adipic acid polyester |
| P-15) | Ethyleneglycol/sebacic acid polyester |
| P-16) | Polycaprolactam |

-continued

| Example | Type of Polymer |
|---|---|
| P-17) | Poly(2-tert-butylphenyl acrylate) |
| P-18) | Poly(4-tert-butylphenel acrylate) |
| P-19) | n-Butylmethacrylate/N-vinyl-2-pyrrolidone copolymer (90:10) |
| P-20) | Methyl methacrylate/vinyl chloride copolymer (70:30) |
| P-21) | Methyl methacrylate/styrene copolymer (90:10) |
| P-22) | Methyl methacrylate/ethyl acrylate copolymer (50:50) |
| P-23) | n-Butyl methacrylate/methyl methacrylate/styrene copolymer (50:30:20) |
| P-24) | Vinyl acetate/acrylamide copolymer (85:15) |
| P-25) | Vinyl chloride/vinyl acetate copolymer (65:35) |
| P-26) | Methyl methacrylate/acrylonitrile copolymer (65:35) |
| P-27) | Diacetoneacrylamide/methyl methacrylate copolymer (50:50) |
| P-28) | Vinyl methyl ketone/isobutyl methacrylate copolymer (55:45) |
| P-29) | Ethyl methacrylate/n-butyl acrylate copolymer (70:30) |
| P-30) | Diacetoneacrylamide/n-butyl acrylate copolymer (60:40) |
| P-31) | Methylmethacrylate/cyclohexyl methacrylate copolymer (50:50) |
| P-32) | n-Butyl acrylate/phenyl methacrylate/ciacetoneacrylamide copolymer (70:20:10) |
| P-33) | N-tert-Butymethacrylamide/methyl methacrylate/-acrylic acid copolymer (60:30:10) |
| P-34) | Methyl methacrylate/styrene/vinylsulfonamide copolymer (70:20:10) |
| P-35) | Methyl methacrylate/phenyl vinyl ketone copolymer (70:30) |
| P-36) | n-Butyl acrylate/methyl methacrylate/n-butyl methacrylate copolymer (35:35:30) |
| P-37) | n-Butyl methacrylate/pentyl methacrylate/N-vinyl-2-pyrrolidone copolymer (38:38:24) |
| P-38) | Methyl methacrylate/n-butyl methacrylate/isobutyl methacrylate/acrylic acid copolymer (37:29:25:9) |
| P-39) | n-Butyl methacrylate/acrylic acid copolymer (95:5) |
| P-40) | Methyl methacrylate/acrylic acid copolymer (95:5) |
| P-41) | Benzyl methacrylate/acrylic acid copolymer (90:10) |
| P-42) | n-Butyl methacrylate/methyl methacrylate/benzyl methacrylate/acrylic acid copolymer (35:35:25:5) |
| P-43) | n-Butyl methacrylate/methyl methacrylate/benzyl methacrylate copolymer (35:35:30) |
| P-44) | Poly(3-pentyl acrylate) |
| P-45) | Cyclohexyl methacrylate/methyl methacrylate/n-propyl methacrylate copolymer (37:29:34) |
| P-46) | Poly(pentyl methacrylate) |
| P-47) | Methyl methacrylate/n-butyl methacrylate copolymer (65:35) |
| P-48) | Vinyl acetate/vinyl propionae copolymer (75:25) |
| P-49) | n-Butyl methacrylate/3-acryloxybutane-1-sulfonic acid, sodium salt, copolymer (97:3) |
| P-50) | n-Butyl methacrylate/methyl methacrylate/acrylamide copolymer (35:35:30) |
| P-51) | n-Butyl methacrylate/methyl acrylate/vinyl chloride copolymer (37:36:27) |
| P-52) | n-Butyl methacrylate/styrene copolymer (90:10) |
| P-53) | Methyl methacrylate/N-vinyl-2-pyrrolidone copolymer (90:10) |
| P-54) | n-Butyl methacrylate/vinyl chloride copolymer (90:10) |
| P-55) | n-Butyl methacrylate/styrene copolymer (70:30) |
| P-56) | Poly(N-sec-butylacrylamide) |
| P-57) | Poly(N-tert-butylacrylamide) |
| P-58) | Diacetoneacrylamide/methyl methacrylate copolymer (62:38) |
| P-59) | Poly(cyclohexyl methacrylate)/methyl methacrylate copolymer (60:40) |
| P-60) | N-tert-Butylacrylamide/methyl methacrylate copolymer (40:60) |
| P-61) | Poly(N-n-Butylacrylamide) |
| P-62) | Poly(tert-butyl methacrylate)/N-tert-butyl-acrylamide copolymer (50:50) |
| P-63) | tert-Butyl methacrylate/methyl methacrylate copolymer (70:30) |
| P-64) | Poly(N-tert-butylacrylamide) |
| P-65) | N-tert-Butylacrylamide/methyl methacrylate copolymer (60:40) |

-continued

| Example | Type of Polymer |
|---|---|
| P-66) | Methyl methacrylate/acrylonitrile copolymer (70:30) |
| P-67) | Methyl methacrylate/vinyl methyl ketone copolymer (38:62) |
| P-68) | Methyl methacrylate/styrene copolymer (75:25) |
| P-69) | Methyl methacrylate/hexyl methacrylate copolymer (70:30) |
| P-70) | Poly(benzyl acrylate) |
| P-71) | Poly(4-biphenyl acrylate) |
| P-72) | Poly(4-butoxycarbonylphenyl acrulate) |
| P-73) | Poly(sec-butyl acrylate) |
| P-74) | Poly(tert-butyl acrylate) |
| P-75) | Poly[3-chloro-2,2-bis(chloromethyl)propyl acrylate] |
| P-76) | Poly(2-chlorophenyl acrylate) |
| P-77) | Poly(4-chlorophenyl acrylate) |
| P-78) | Poly(pentachlorophenyl acrylate) |
| P-79) | Poly(4-cyanobenzyl acrylate) |
| P-80) | Poly(cyanoethyl acrylate) |
| P-81) | Poly(4-cyanophenyl acrylate) |
| P-82) | Poly(4-cyano-3-thiabutyl acrylate) |
| P-83) | Poly(cyclohexyl acrylate) |
| P-84) | Poly(2-ethoxycarbonylphenyl acrylate) |
| P-85) | Poly(3-ethoxycarbonylphenyl acrylate) |
| P-86) | Poly(4-ethoxycarbonylphenyl acrylate) |
| P-87) | Poly(2-ethoxyethyl acrylate) |
| P-88) | Poly(3-ethoxypropyl acrylate) |
| P-89) | Poly(1H, 1H, 5H-octafluoropentyl acrylate) |
| P-90) | Poly(heptyl acrylate) |
| P-91) | Poly(hexyldecyl acrylate) |
| P-92) | Poly(hexyl acrylate) |
| P-93) | Poly(iso-butyl acrylate) |
| P-94) | Poly(iso-propyl acrylate) |
| P-95) | Poly(3-methoxybutyl acrylate) |
| P-96) | Poly(2-methoxycarbonylphenyl acrylate) |
| P-97) | Poly(3-methoxycarbonylphenyl acrylate) |
| P-98) | Poly(4-methoxycarbonylphenyl acrylate) |
| P-99) | Poly(2-methoxyethyl acrylate) |
| P-100) | Poly(4-methoxyphenyl acrylate) |
| P-101) | Poly(3-methocypropyl acrylate) |
| P-102) | Poly(3,5-dimethylademantyl acrylate) |
| P-103) | Poly(3-methoxyaminophenyl acrylate) |
| P-104) | Poly(vinyl tert-butyrate) |
| P-105) | Poly(2-methylbutyl acrylate) |
| P-106) | Poly(3-methylbutyl acrylate) |
| P-107) | Poly(1,3-dimethylbutyl acrylate) |
| P-108) | Poly(2-methylpentyl acrylate) |
| P-109) | Poly(2-napthyl acrylate) |
| P-110) | Poly(phenyl methacrylate) |
| P-111) | Poly(propyl acrylate) |
| P-112) | Poly(m-tolyl acrylate) |
| P-113) | Poly(o-tolyl acrylate) |
| P-114) | Poly(p-tolyl acrylate) |
| P-115) | Poly(N,N-dibutylacrylamide) |
| P-116) | Poly(iso-hexylacrylamide) |
| P-117) | Poly(iso-octylacrylamide) |
| P-118) | Poly(N-methyl-N-phenylacrylamide) |
| P-119) | Poly(adamantyl methacrylate) |
| P-120) | Poly(benzyl methacrylate) |
| P-121) | Poly(2-bromoethyl methacrylate) |
| P-122) | Poly(2-N-tert-butylaminoethyl methacrylate) |
| P-123) | Poly(sec-butyl methacrylate) |
| P-124) | Poly(tert-butyl methacrylate) |
| P-125) | Poly(2-chloroethyl methacrylate) |
| P-126) | Poly(2-cyanoethyl methacrylate) |
| P-127) | Poly(2-cyanomethylphenyl methacrylate) |
| P-128) | Poly(4-cyanophenyl methacrylate) |
| P-129) | Poly(cyclohexyl methacrylate) |
| P-130) | Poly(dodecyl methacrylate) |
| P-131) | Poly(diethylaminoethyl methacrylate) |
| P-132) | Poly(2-ethylsulfonylethyl methacrylate) |
| P-133) | Poly(hexadecyl methacrylate) |
| P-134) | Poly(hexyl methacrylate) |
| P-135) | Poly(2-hydroxypropyl methacrylate) |
| P-136) | Poly(4-methoxycarbonylphenyl methacrylate) |
| P-137) | Poly(3,5-dimethyladamantyl methacrylate) |
| P-138) | Poly(dimethylaminoethyl methacrylate) |
| P-139) | Poly(3,3-dimethylbutyl methacrylate) |
| P-140) | Poly(3,3-dimethyl-2-ethylbutyl methacrylate) |
| P-141) | Poly(3,5,5-trimethylhexyl methacrylate) |
| P-142) | Poly(octadecyl methacrylate) |
| P-143) | Poly(tetradecyl methacrylate) |
| P-144) | Poly(4-butoxycarbonylphenylmethacrylamide) |

-continued

| Example | Type of Polymer |
|---|---|
| P-145) | Poly(4-carboxyphenylmethacrylamide) |
| P-146) | Poly(4-ethoxycarbonylphenylmethacrylamide) |
| P-147) | Poly(4-methoxycarbonylphenylmethacrylamide) |
| P-148) | Poly(butyl butoxycarbonylmethacrylate) |
| P-149) | Poly(butyl chloroacrylate) |
| P-150) | Poly(butyl cyanoacrylate) |
| P-151) | Poly(cyclohexyl chloroacrylate) |
| P-152) | Poly(ethyl chloroacrylate) |
| P-153) | Poly(ethyl ethoxycarbonylmethacrylate) |
| P-154) | Poly(ethyl ethacrylate) |
| P-155) | Poly(ethyl fluoromethacrylate) |
| P-156) | Poly(hexyl hexyloxycarbonylmethacrylate) |
| P-157) | Poly(iso-butyl chloroacrylate) |
| P-158) | Poly(iso-propyl chloroacrylate) |
| P-159) | Trimethylenediamine/glutaric acid polyamide |
| P-160) | Hexamethylendiamine/adipic acid polyamide |
| P-161) | Poly(α-pyrrolidone) |
| P-162) | Poly(ε-caprolactam) |
| P-163) | Hexamethylenediisocyanate/1,4-butanediol polyurethane |
| P-164) | p-Phenylenediisocyanate/ethylene glycol polyurethane |

SYNTHESIS EXAMPLE 1

Preparation of Methyl Methacrylate Polymer (P-3)

Methyl methacrylate (50.0 grams), 0.5 grams of poly(sodium acrylate) and 200 ml of distilled water were introduced into a 500 ml three necked flask and heated to 80° C. with stirring under a nitrogen stream. Dimethyl azobisiso-butyrate (500 mg) was added as a polymerization initiator and polymerization started.

The reaction mixture was cooled after polymerizing for a period of 2 hours and 48.7 grams of the polymer P-3 was obtained by recovering by filtration and washing the polymer which had formed in the form of beads with water.

SYNTHESIS EXAMPLE 2

Preparation of t-Butylacrylamide Polymer (P-57)

A mixture of 50.0 grams of t-butylacrylamide and 250 ml of toluene was introduced into a 500 ml three necked flask and heated to 80° C. with stirring under a nitrogen stream. A toluene solution (10 ml) containing 500 mg of azobisiso-butyronitrile was added as a polymerization initiator and polymerization started.

The reaction mixture was cooled after polymerizing for a period of 3 hours and 47.9 grams of the polymer P-57 (a number average molecular weight: about 60,000) was obtained by recovering by filtration the solid which precipitated out on pouring the mixture into 1 liter of hexane, washing the solid with hexane, and drying the product by heating under reduced pressure.

Cyan couplers represented by general formulae (I) or (II) for use in the present invention are described in detail below.

The term "aliphatic group" here includes saturated and unsaturated, linear chain, branched and cyclic alkyl, alkenyl and alkynyl groups.

In general formulae (I) and (II), $R_1$, $R_4$ and $R_5$ are preferably aliphatic groups which have from 1 to 31 carbon atoms (e.g., methyl, butyl, octyl, tridecyl, isohexadecyl, cyclohexyl), aryl groups (e.g., phenyl, naphthyl) or heterocyclic groups (e.g., 2-pyridyl, 2-thiazolyl, 2-imidazolyl, 2-furyl, 8-quinolyl). These groups may be substituted with substituent groups selected from among the alkyl groups, aryl groups, heterocyclic groups, alkoxy groups (e.g., methoxy, 2-methoxyethoxy, tetradecyloxy), aryloxy groups (e.g., 2,4-di-tert-amylphenoxy, 2-chlorophenoxy, 4-cyanophenoxy, 4-butane-sulfonamidophenoxy), acyl groups (e.g., acetyl, benzoyl), ester groups e.g., ethoxycarbonyl, 2,4-di-tert-amylphenoxycarbonyl, acetoxy, benzoyloxy, butoxysulfonyl, toluenesulfonyloxy), amido groups (e.g., acetylamino, butanesulfonamido, dodecylbenzenesulfonamido, dipropylsulfamoylamino), carbamoyl groups (e.g., dimethylcarbamoyl, ethylcarbamoyl), sulfamoyl groups (e.g., butylsulfamoyl), imido groups (e.g., succinimido, hydantoinyl), ureido groups (e.g., phenylureido, dimethylureido), sulfonyl groups (e.g., methane sulfonyl, carboxymethanesulfonyl, phenylsulfonyl), aliphatic or aromatic thio groups (e.g., buthylthio, phenylthio), hydroxyl group, cyano group, carboxyl group, nitro group, sulfo group, halogen atoms etc. In cases where there are two or more substituent groups, these substituent groups may be the same or different.

Aliphatic groups which can be substituted for $R_2$ in general formula (I) include, for example, the methyl, ethyl, propyl, butyl, pentadecyl, tert-butyl, cyclohexyl, cyclohexylmethyl, phenylthiomethyl, dodecyloxyphenylthiomethyl, butanamidomethyl and methoxymethyl.

$R_3$ of formula (I) can be a hydrogen atom, halogen atom, lower alkyl group, aryl group (e.g., phenyl), or an acylamino group (e.g., acetylamino).

Furthermore, $R_8$ in general formula (II) can be a hydrogen atom, halogen atom, alkyl group, aryl group, acrylamino group or a group of non-metal atoms which, together with $R_5$, forms a five or six membered nitrogen containing ring.

$Y_1$ in general formula (I) and $Y_2$ in general formula (II) represent hydrogen atoms or coupling elimination groups (including leaving atoms), typical examples of which include the halogen atoms (e.g., fluorine atom, bromine atom), alkoxy groups (e.g., ethoxy, dodecyloxy, methoxyethylcarbamoylmethoxy, carboxypropyloxy, methylsulfonylethoxy), aryloxy groups (e.g., 4-chlorophenoxy, 4-methoxyphenoxy, 4-carboxyphenoxy), acyloxy groups (e.g., acetoxy, tetradecanoyloxy, benzoyloxy), sulfonyloxy groups (e.g., methanesulfonyloxy, toluenesulfonyloxy), amido groups (e.g., dichloroacetylamino, heptafluorobutylamino, methanesulfonylamino, toluenesulfonylamino), alkoxycarbonyloxy groups (e.g., ethoxycarbonyloxy, benzyloxycarbonyloxy), aryloxycarbonyloxy groups (e.g., phenoxycarbonyloxy), aliphatic or aromatic thio groups (e.g., ethylthio, phenylthio, tetrazolylthio), imido groups (e.g., succinimido, hydantoinlyl) and aromatic azo groups (e.g., phenylazo).

These leaving groups may contain photographically useful groups. The photographically useful group is a group which can provide a development accelerator, a bleach accelerator, a development inhibitor, a dye, a fluorescent whitener when coupled-off. For example, it is a group which can provide a fluorescent whitener as described in U.S. Pat. No. 4,774,181.

The particularly preferred cyan couplers are those in which $R_2$ in general formula (I) is an ethyl group.

Preferred examples of oil soluble cyan couplers which can be used in the present invention are listed below, but the invention is not limited to these examples.

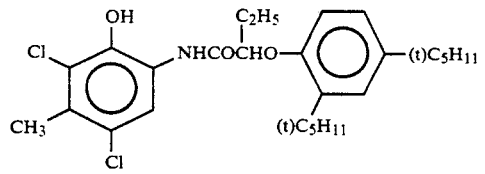

(C-1)

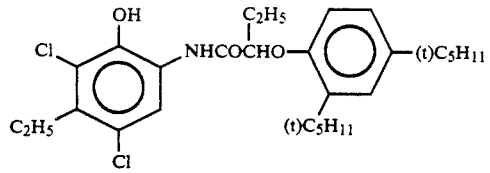

(C-2)

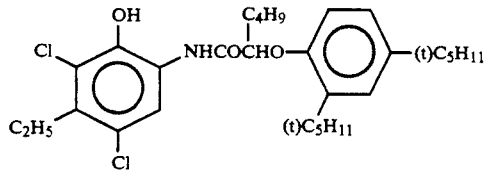

(C-3)

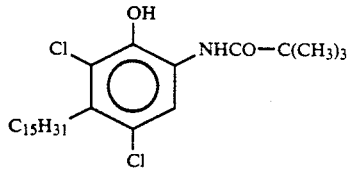

(C-4)

-continued
(C-5)
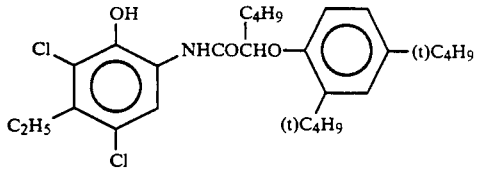
(C-6)
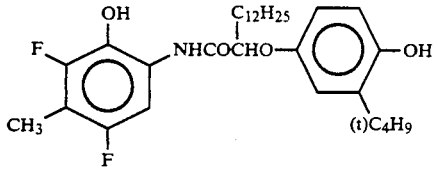
(C-7)
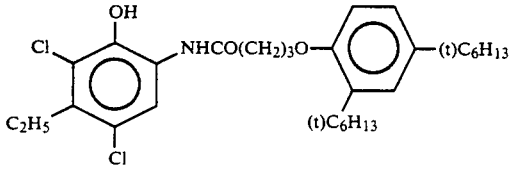
(C-8)
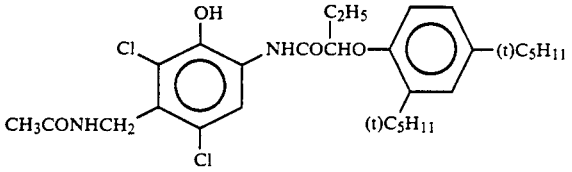
(C-9)
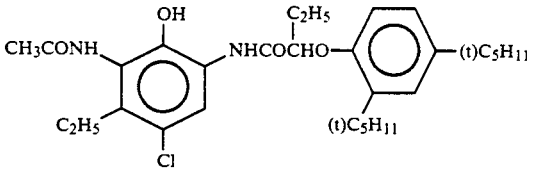
(C-10)
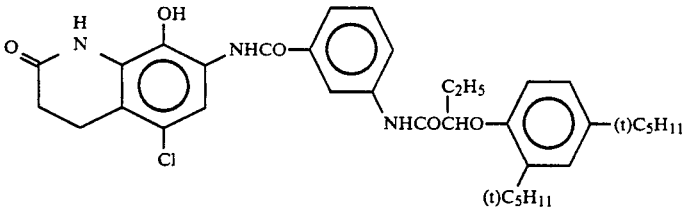
(C-11)
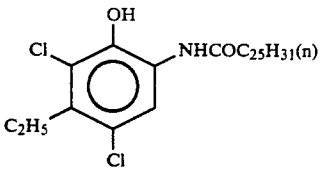
(C-12)
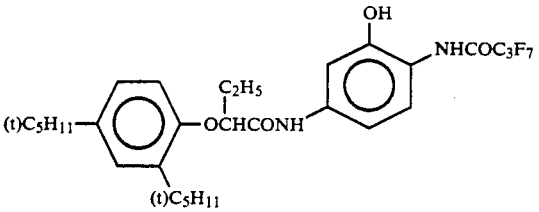

-continued
(C-13)
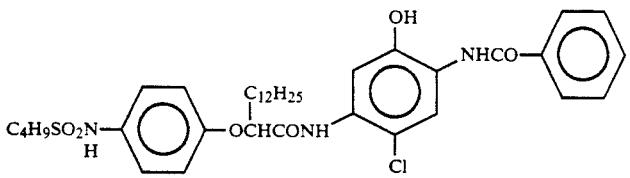
(C-14)
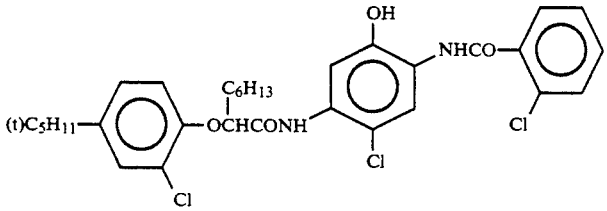
(C-15)
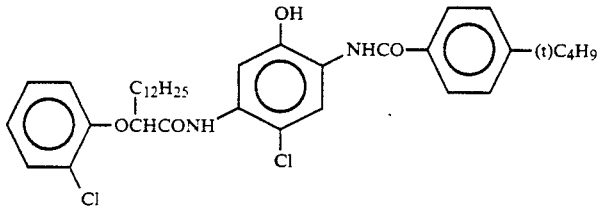
(C-16)
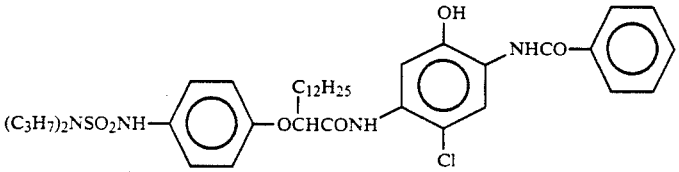
(C-17)
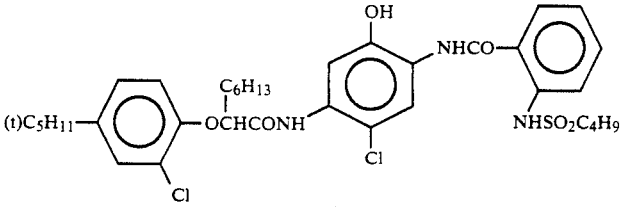
(C-18)
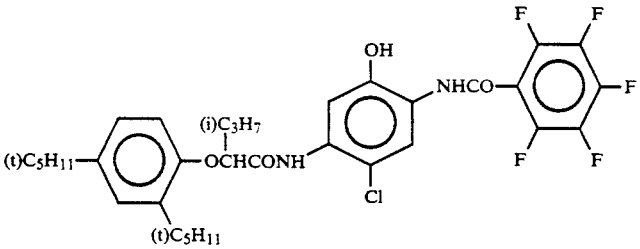
(C-19)
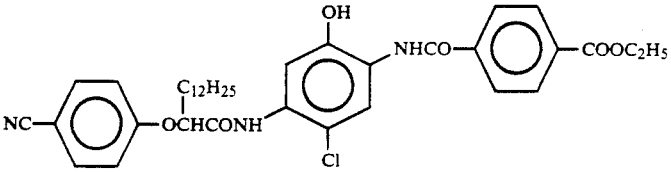

-continued
(C-20)
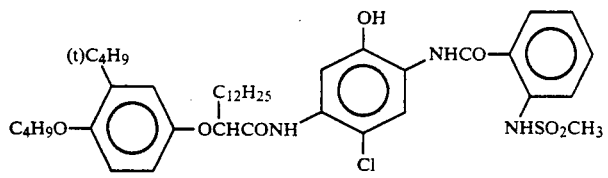
(C-21)
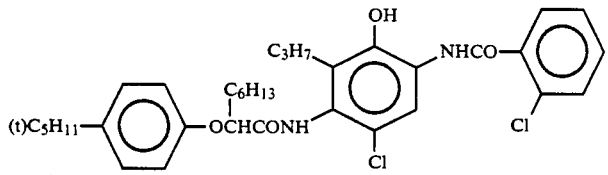
(C-22)
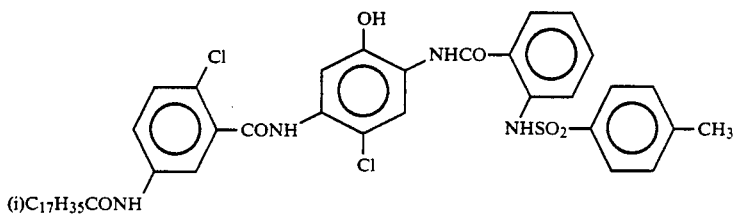
(C-23)
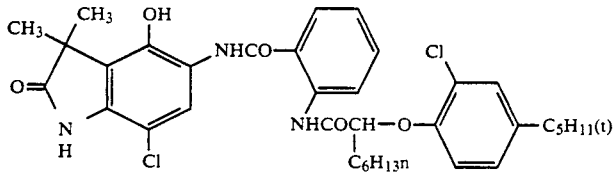
(C-24)
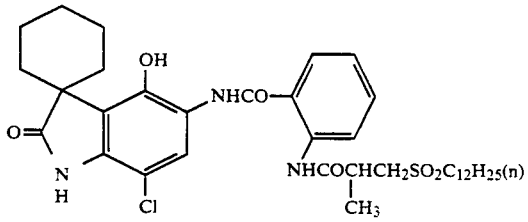
(C-25)
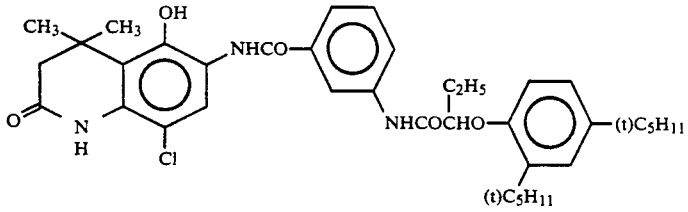
(C-26)
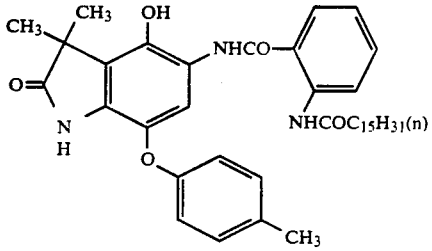

-continued
(C-27)
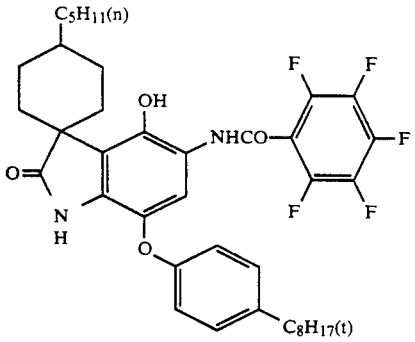
(C-28)
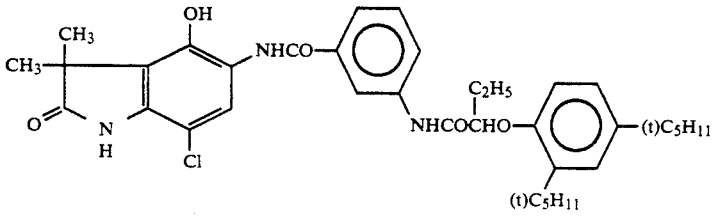
(C-29)
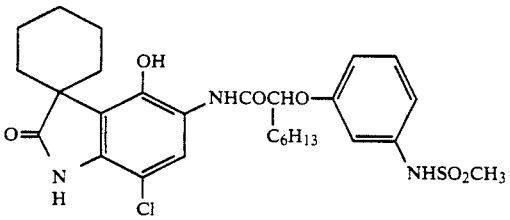
(C-30)
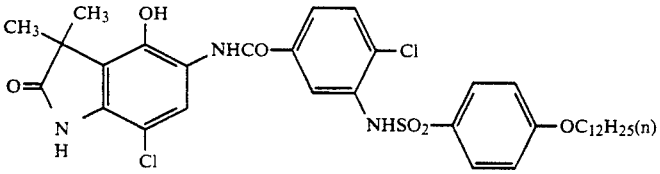
(C-31)
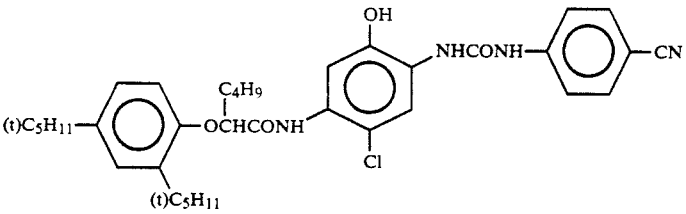
(C-32)
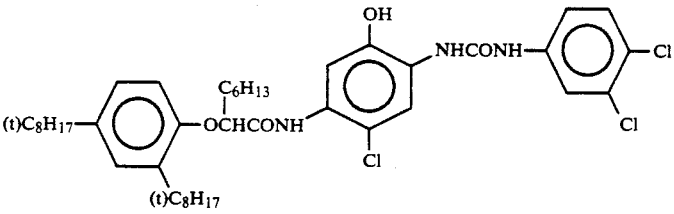
(C-33)
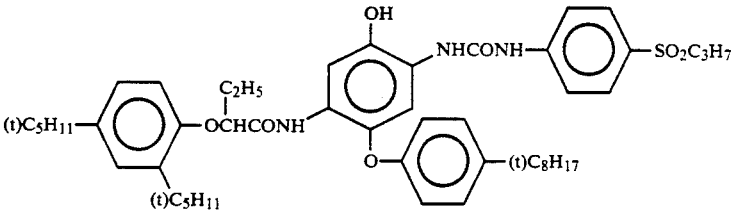

-continued
(C-34)
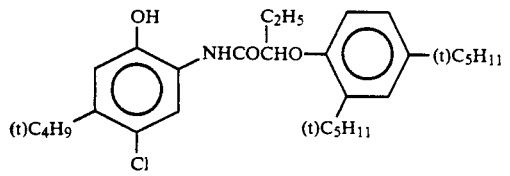
(C-35)
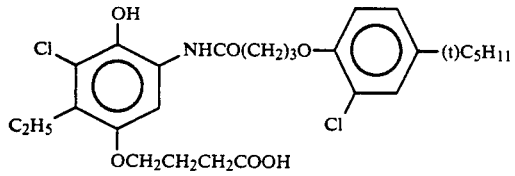
(C-36)
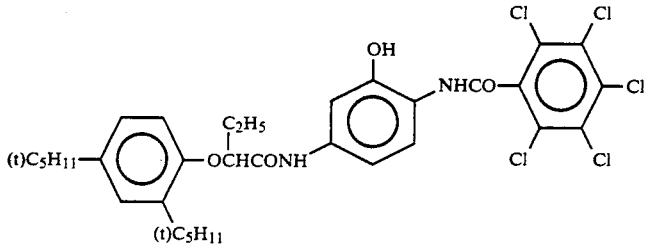
(C-37)
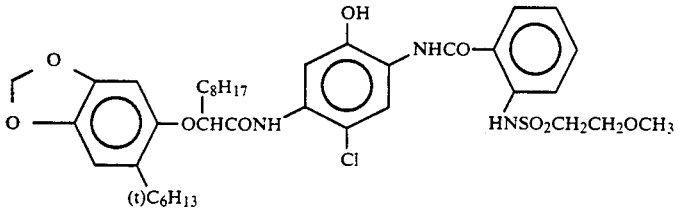
(C-38)
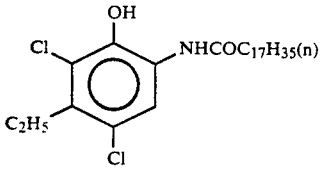
(C-39)
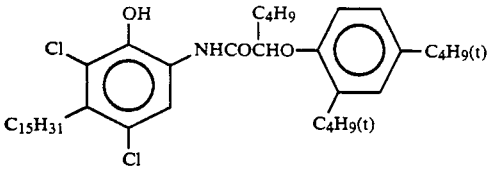
(C-40)
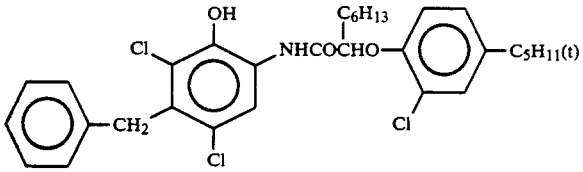
(C-41)
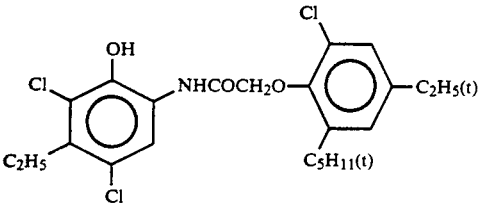

-continued

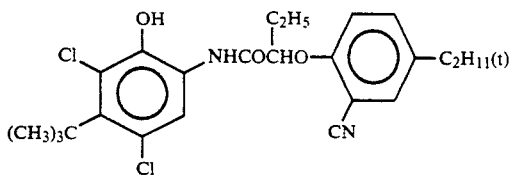

(C-42)

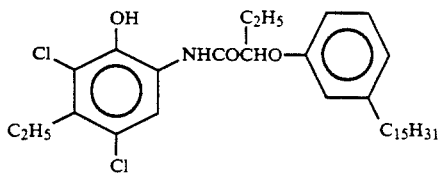

(C-43)

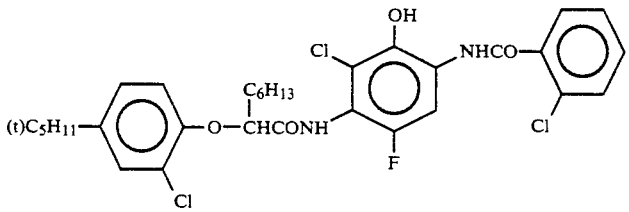

(C-44)

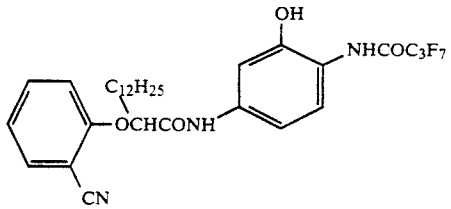

(C-45)

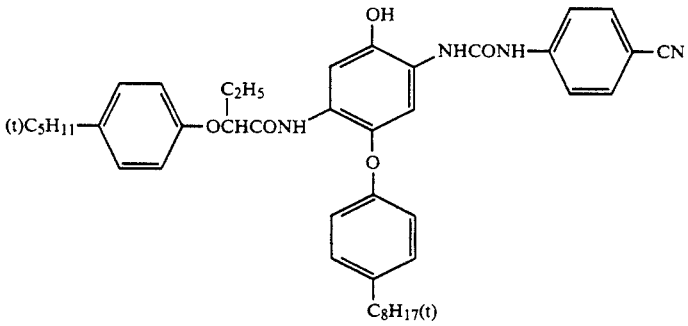

(C-46)

The aforementioned polymers and couplers are preferably mixed with a high boiling point organic solvent, dissolved in a low boiling point or water soluble organic solvent and then mixed at high speed in the presence of a surfactant with an aqueous solution of a hydrophilic colloid such as gelatin, etc. and the oil soluble components are then emulsified and dispersed in the aqueous solution of the hydrophilic colloid, and it is in this state that the oil soluble components are mixed with the high silver chloride content emulsion grains to prepare a coating liquid.

Embodiments incorporating the polymers of the present invention have more stable photographic properties on storage of the coating liquid than where no polymer is used which is clearly desirable. Moreover, the photographic properties are even more stable when the coating liquids are prepared after removing the low boiling solvent to the extent indicated below by distillation under reduced pressure.

In addition to removal by distillation under reduced pressure, the low boiling point or water soluble organic solvent can be removed from the emulsified dispersion by evaporating the solvent at room temperature or by cooling the mixture to form a gel and then washing with water, etc. Any of these methods can be employed.

The low boiling point or water soluble organic solvent is preferably removed so that the ratio by weight of the solvent with respect to the couplers is not more than ½, preferably not more than 1/5, and most desirably not more than 1/10.

A low boiling point organic solvent is defined here as a solvent with a boiling point at atmospheric pressure of not more than 140° C.

A high boiling point oil is an organic solvent with a boiling point at least 150° C. and which will not react with the oxidized form of a developing agent including, for example, a phenol derivative, phthalic acid alkyl ester, phosphate ester, citrate ester, benzoate ester, alkylamide, aliphatic ester, trimesic acid ester, etc.

High boiling point organic solvents which can be used in the present invention have been disclosed in U.S. Pat. Nos. 2,322,027, 2,533,514, 2,835,579, 3,287,134, 2,353,282, 2,852,383, 3,554,755, 3,878,137, 3,878,142, 3,700,454, 3,748,141, 3,779,785 and 3,837,863, in British Patents 958,441 and 1,222,753, in West German Patent Applications (OLS) 2,538,889, in JP-A-47-1031, JP-A-49-90523, JP-A-50-23823, JP-A-51-26037, JP-A-51-27921, JP-A-51-27922, JP-A-51-26035, JP-A-51-26036, JP-A-50-62632, JP-A-53-1520, JP-A-53-1521, JP-A-53-15127, JP-A-54-119921, JP-A-54-119922, JP-A-55-25057, JP-A-55-36889, JP-A-56-19049 and JP-A-56-81836, and in JP-B-48-29060 (the term "JP-B" as used herein means an "examined Japanese patent publication").

Low boiling point, or water soluble, organic solvents which can be used together with, or instead of, the high boiling point solvents include those described in U.S. Pat. Nos. 2,801,171 and 2,949,360 etc. Organic solvents of low boiling point which are insoluble in water and form heterogeneous mixtures include ethyl acetate, propyl acetate, butyl acetate, butanol, chloroform, carbon tetrachloride, nitromethane, nitroethane, benzene etc., and water soluble organic solvents include acetone, methyl iso-butyl ketone, $\beta$-ethoxyethyl acetate, methoxyglycol acetate, methanol, ethanol, acetonitrile, dioxane, dimethylformamide, dimethylsulfoxide, hexamethylphosphoramide, diethyleneglycol monophenyl ether, phenoxyethanol etc.

Surfactants can be used as dispersion promoters, and the use of anionic surfactants such as, for example, alkylbenzenesulfonates, alkylnaphthalenesulfonates, alkylsulfonates, alkylsulfate esters, alkylphosphate esters, sulfosuccinate esters, and sulfoalkylpolyoxyethylenealkylphenyl ethers etc., non-ionic surfactants such as, for example, steroid based saponin, alkyleneoxide derivatives and glycidol derivatives etc., amphoteric surfactants such as, for example, amino acids, aminoalkylsulfonic acids and alkylbetaines etc., and cationic surfactants such as, for example, quaternary ammonium salts etc., is preferred. Actual examples of these surfactants have been described in "Surfactants Handbook" (Sangyo Zusho, 1966) and in "Emulsifying Agent and Emulsification Apparatus Research, Technical Data Book" (Kagaku Hanronsha, 1978).

Of the yellow couplers which can be used in the present invention, the use of the acylacetamide derivatives, such as the benzoylacetanilides and pivaloylacetanilides etc., is preferred.

Compounds represented by the general formulae (Y-1) and (Y-2) as indicated below are ideal as yellow couplers.

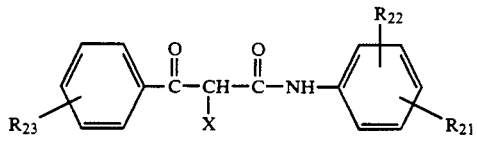

(Y-1)

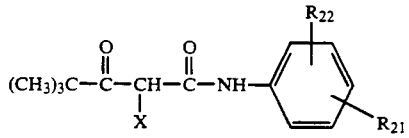

(Y-2)

In these formulae, X represents a hydrogen atom or a coupling leaving group. $R_{21}$ represents a nondiffusible group having a total number of from 8 to 32 carbon atoms. $R_{22}$ represents a hydrogen atom, one or more halogen atom(s), a lower alkyl group, a lower alkoxy group, or a nondiffusible group having a total of from 8 to 32 carbon atoms. $R_{23}$ represents a hydrogen atom or substituent groups. In cases where there are two or more groups represented by $R_{23}$, these groups may be the same or different.

Details of pivaloylacetanilide type yellow couplers are described in U.S. Pat. No. 4,622,287 and 4,623,616.

Details of benzoylacetanilide type yellow couplers have been described in U.S. Pat. Nos. 3,408,194, 3,933,501, 4,046,575, 4,133,958 and 4,401,752 etc.

Typical examples of pivaloylacetanilide type yellow couplers include the compound (Y-1) to (Y-39) disclosed in U.S. Pat. No. 4,622,287, and of these compounds the use of (Y-1), (Y-4), (Y-6), (Y-7), (Y-15), (Y-21), (Y-22), (Y-23), (Y-26), (Y-35), (Y-36), (Y-37), (Y-38) and (Y-39) etc. is preferred.

The illustrative compounds (Y-1) to (Y-33) are given in U.S. Pat. No. 4,623,616, and of these compounds, those indicated as (Y-2), (Y-7), (Y-8), (Y-12), (Y-20), (Y-21), (Y-23) and (Y-29) etc. are preferred.

Other preferred yellow couplers include typical example (34) of U.S. Pat. No. 3,408,194, illustrative compounds (16) and (19) of U.S. Pat. No. 3,933,501, illustrative compound (9) of U.S. Pat. No. 4,046,575, illustrative compound (1) of U.S. Pat. No. 4,133,958, illustrative compound 1 of U.S. Pat. No. 4,401,752, and the compounds with substituents (a) to (g) as indicated below.

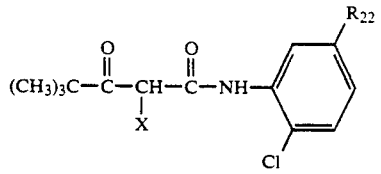

| Compound | $R_{22}$ | X |
|---|---|---|
| a | $-COOCH(CH_3)COOC_{12}H_{25}$ | 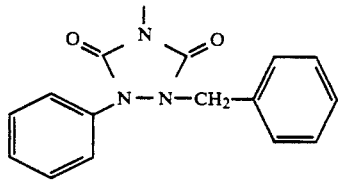 |
| b | $-COOCH(C_4H_9)COOC_{12}H_{25}$ | As above |
| c | 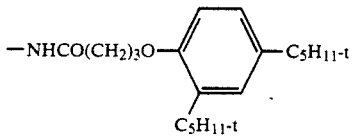 | 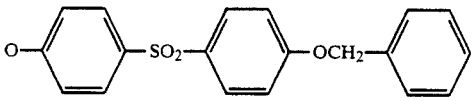 |
| d | As above | 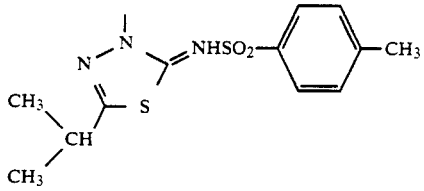 |
| e | As above | 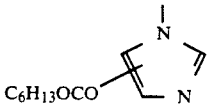 |
| f | $-NHSO_2C_{12}H_{25}$ | 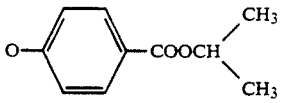 |
| g | $-NHSO_2C_{16}H_{33}$ | 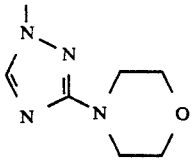 |

Those couplers as described above in which the leaving atom is a nitrogen atom are especially desirable.

Furthermore, the oil protected type indazole based or cyanoacetyl based couplers, and preferably the 5-pyrazolone based couplers and the pyrazoloazole based couplers such as the pyrazolotriazoles, can be used as the magenta couplers of the present invention. The 5-pyrazolone based couplers substituted with an arylamino group or an acylamino group in the 3-position are preferred from the point of view of the hue of the colored dye and color forming density, and typical examples have been disclosed in U.S. Pat. Nos. 2,311,082, 2,343,703, 2,600,788, 2,908,573, 3,062,653, 3,152,896, and 3,936,015 etc. The nitrogen atom leaving groups disclosed in U.S. Pat. No. 4,310,619 and the arylthio groups disclosed in U.S. Pat. No. 4,351,897 are the preferred leaving groups as two equivalent 5-pyrazolone based couplers. Furthermore, high color densities can be obtained with the 5-pyrazolone based couplers having ballast groups disclosed in European Pat. No. 73,636.

The pyrazolobenzimidazoles disclosed in U.S. Pat. No. 3,369,879, and preferably the pyrazolo(5,1-c)(1,2,4)triazoles disclosed in U.S. Pat. No. 3,725,067, the pyrazolotetrazoles disclosed in *Research Disclosure* 24220 (Jun. 1984) and the pyrazolopyrazoles disclosed in *Research Disclosure* 24230 (Jun. 1984) can be used as pyrazoloazole based couplers. All of the above mentioned couplers may take the form of polymeric couplers.

In practice, these compounds can be represented by the general formulae (M-1), (M-2) or (M-3) as indicated below.

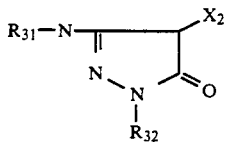

(M-1)

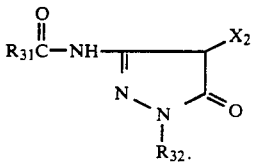

(M-2)

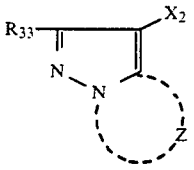

(M-3)

Here, $R_{31}$ represents a nondiffusible group having a total number of from 8 to 32 Carbon atoms, and $R_{32}$ represents a phenyl group or a substituted phenyl group. $R_{33}$ represents a hydrogen atom or a substituent group. Z represents a group of non-metal atoms required to form a five membered azole ring which has 2 to 4 nitrogen atoms, and the said azole ring may have substituent groups (including condensed rings).

$X_2$ represents a hydrogen atom or a leaving group. Details of the substituent groups for $R_{33}$ and of the substituent groups for the azole ring have been disclosed in U.S. Pat. No. 4,540,654.

From among the pyrazoloazole based couplers, the use of the imidazo[1,2-b]pyrazoles disclosed in U.S. Pat. No. 4,500,630 is preferred in view of the low absorption by the colored dye on the yellow side and light fastness. The use of the pyrazolo[1,5-b][1,2,4]triazoles disclosed in U.S. Pat. No. 4,540,654 is especially desirable.

Moreover, the use of the pyrazolotriazole couplers which have a branched alkyl group bonded directly to the 2-, 3- or 6-position of the pyrazolotriazole ring (disclosed in JP-A-61-65245), the pyrazoloazole couplers which contain a sulfonamido group within the molecule (disclosed in JP-A-61-65246), the pyrazoloazole couplers which have an alkoxyphenylsulfonamido ballast group (disclosed in JP-A-61-147254), and the pyrazolotriazole couplers which have an alkoxy group or aryloxy group in the 6-position (disclosed in European Patent 226,849A is preferred.

Examples of these couplers are given below.

| Compound | $R_{33}$ | $R_{34}$ | $X_2$ |
|---|---|---|---|
| | | 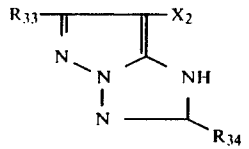 | |
| M-1 | $CH_3$— | 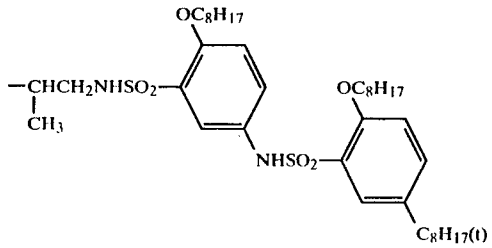 | Cl |
| M-2 | As above | 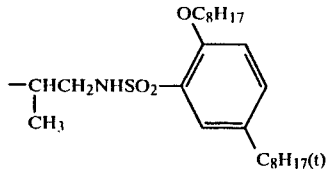 | As above |
| M-3 | As above | 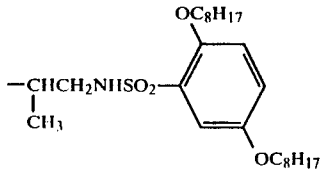 | 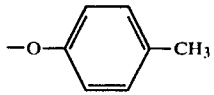 |
| M-4 | 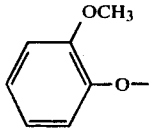 | 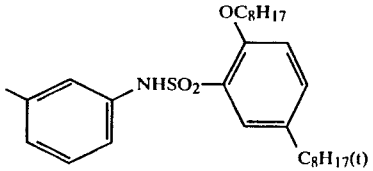 | 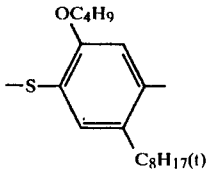 |

-continued
| Compound | $R_{33}$ | $R_{34}$ | $X_2$ |
|---|---|---|---|
| M-5 | $CH_3$— | 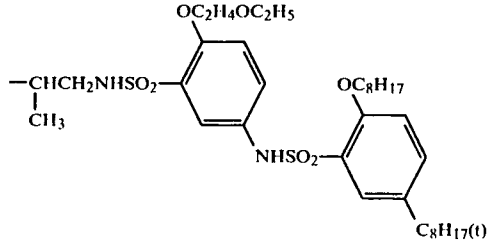 | Cl |
| M-6 | As above | 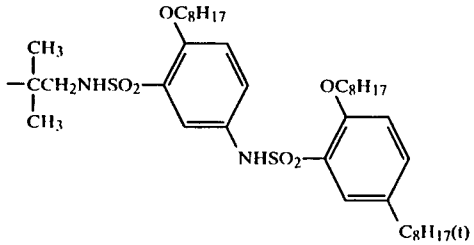 | As above |
| M-7 | 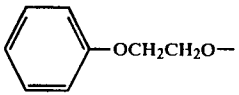 | 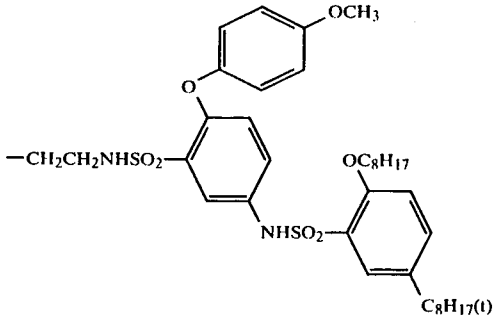 | 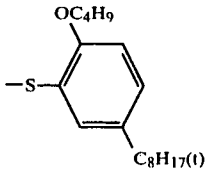 |
| M-8 | $CH_3CH_2O$— | As above | As above |
| M-9 | 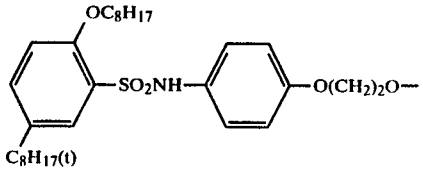 | 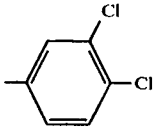 | As above |

-continued
| Compound | $R_{33}$ | $R_{34}$ | $X_2$ |
|---|---|---|---|
| M-10 | 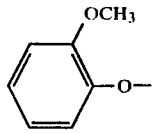 | 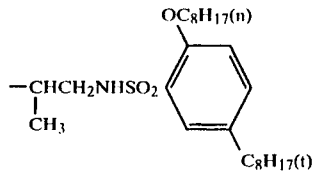 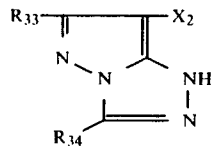 | Cl |
| M-11 | $CH_3$— | 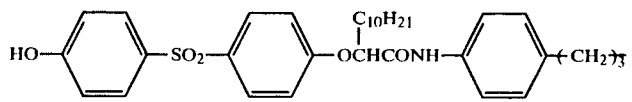 | Cl |
| M-12 | As above | 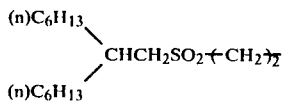 | As above |
| M-13 | 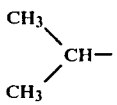 | 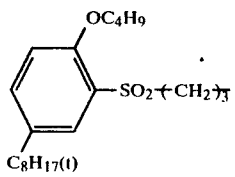 | As above |
| M-14 | 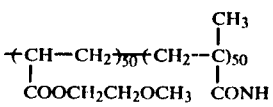 | 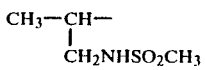 | As above |

-continued
| Compound | $R_{33}$ | $R_{34}$ | $X_2$ |
|---|---|---|---|
| M-15 | 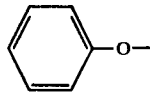 | 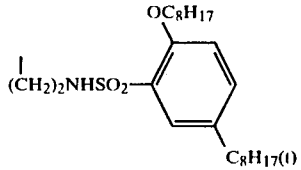 | Cl |
| M-16 | 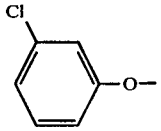 | 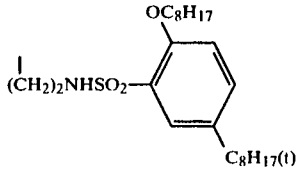 | 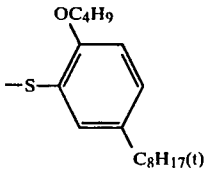 |
| (M-17) | | 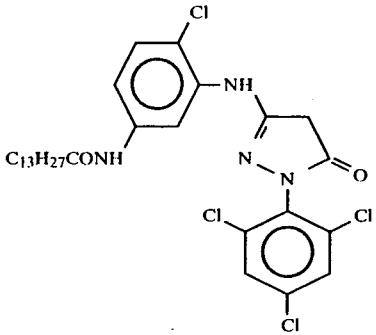 | |
| (M-18) | | 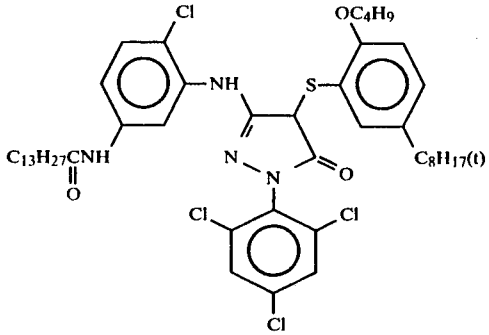 | |

-continued
| Compound | $R_{33}$ | $R_{34}$ | $X_2$ |
|---|---|---|---|
| (M-19) | | 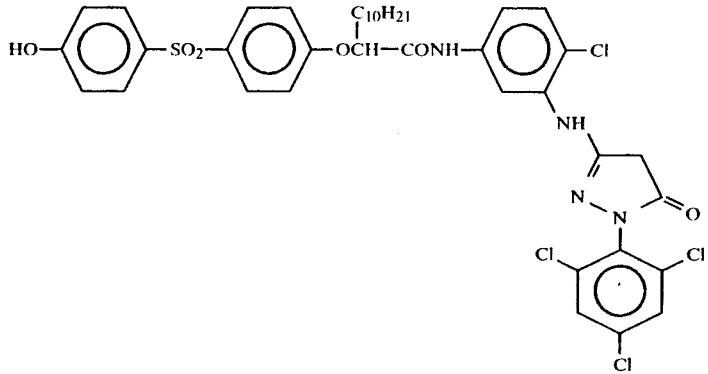 | |
| (M-20) | | 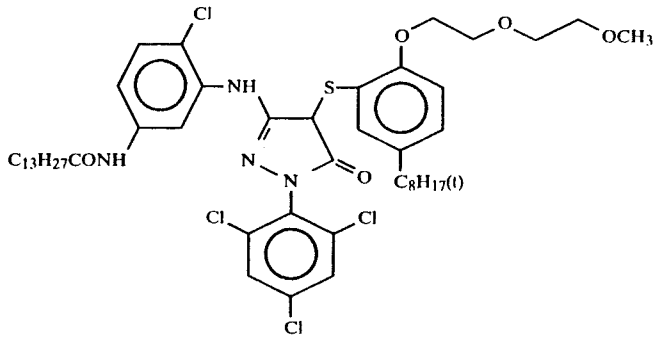 | |
| (M-21) | | 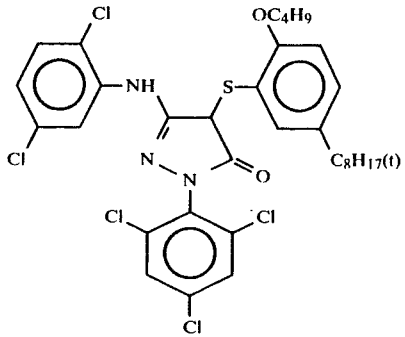 | |

-continued
| Compound | $R_{33}$ | $R_{34}$ | $X_2$ |
|---|---|---|---|
| (M-22) | | 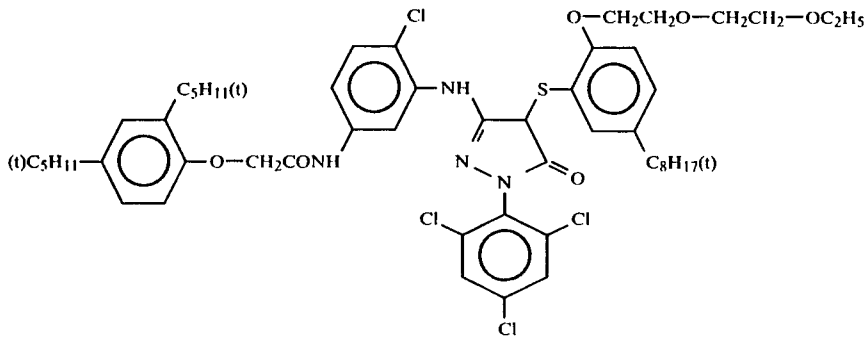 | |
| (M-23) | | 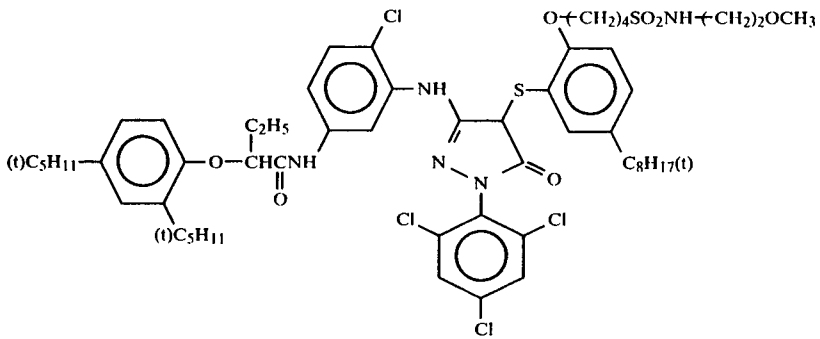 | |
| (M-24) | | 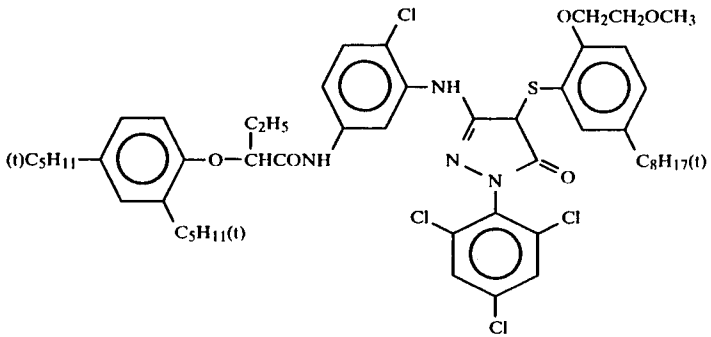 | |

-continued
| Compound | $R_{33}$ | $R_{34}$ | $X_2$ |
|---|---|---|---|
| (M-25) | | 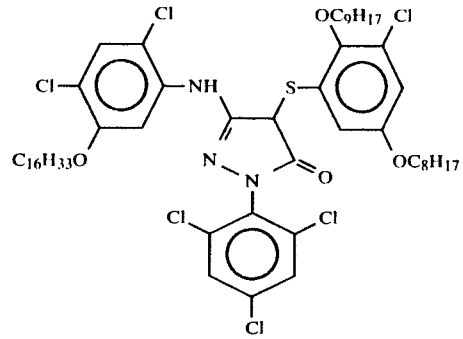 | |
| (M-26) | | 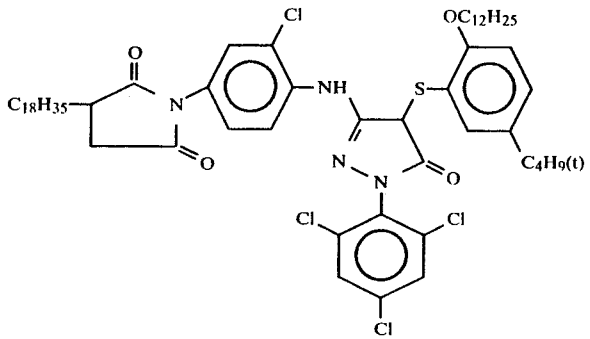 | |
| (M-27) | | 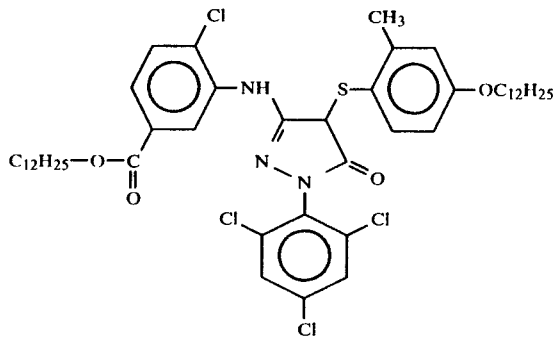 | |

-continued
| Compound | $R_{33}$ | $R_{34}$ | $X_2$ |
|---|---|---|---|
| (M-28) | | 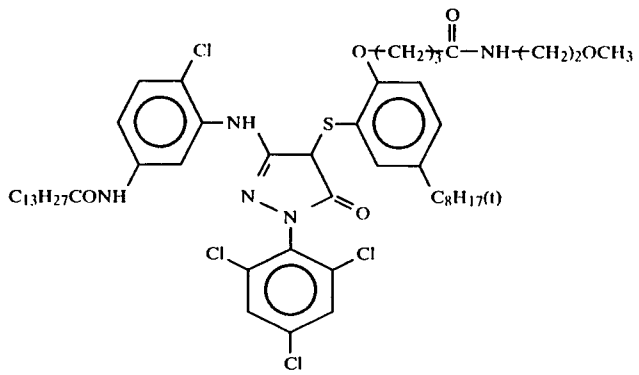 | |
| (M-29) | | 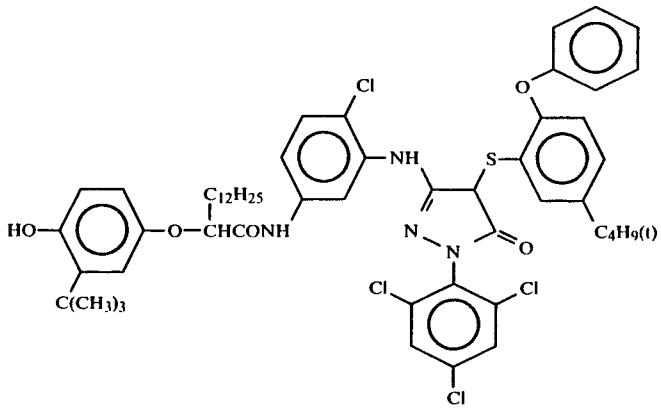 | |

-continued
| Compound | $R_{33}$ | $R_{34}$ | $X_2$ |
|---|---|---|---|
| (M-30) | | 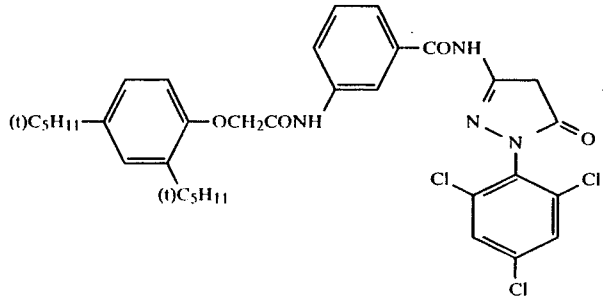 | |
| (M-31) | | 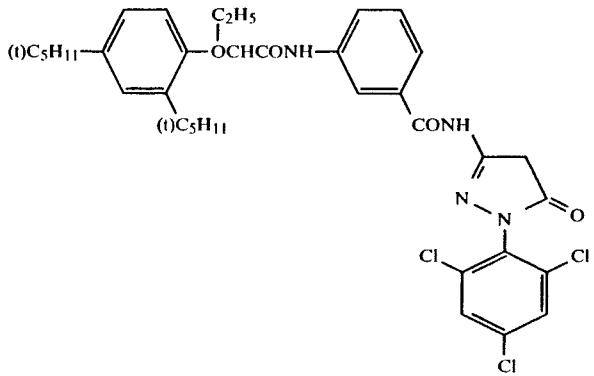 | |
| (M-32) | | 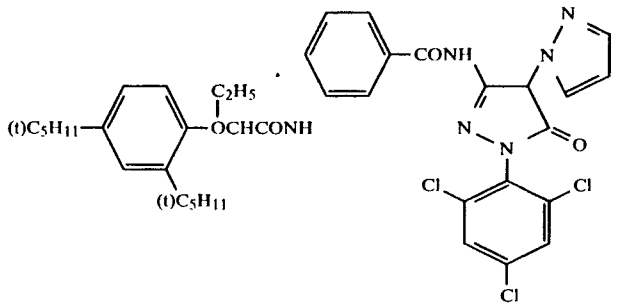 | |

The silver halide emulsion which is used in the present invention consists of silver chloride grains or silver chlorobromide grains which are substantially iodide free of which the silver chloride content is at least 90 mol. %. Preferably, it is a silver chlorobromide grain of which the silver chloride content is at least 95 mol. %, and more preferably, it is a silver chlorobromide grain of which the silver chloride content is 98 to 99.9 mol. %.

The term "substantially iodide free" means that the silver iodide content is not more than 2 mol. % and preferably that the silver iodide content is not more than 0.5 mol. %.

The halogen composition distribution within the silver halide grains may be uniform or there may be a composition gradient. However, the localization of a silver bromide rich phase within the silver halide grains is preferred, and the localization of such a phase in the vicinity of the surface of the said grains or in the vicinity of the apices of the grains is especially desirable. The silver bromide rich phase (the silver bromide localized phase) means a region in which the silver bromide content distribution is relatively higher than the around in a grain. The preferred silver bromide content in the localized layer is not more than 70 mol. % and the rest is a substantially iodide free silver chloride, more preferably the silver bromide content is from 10 to 60 mol. %. The existence of the said phases can be confirmed using an X-ray diffraction method.

Here, the term "in the vicinity of the apices" signifies within the area of the squares which have the apex of the grain (the point of intersection of the edges of a cube or a regular crystalline grain which can be regarded as being cubic in form) as one corner and of which the length of one side is about one third (and most desirably about one fifth) of the diameter of a circle of the same area as the projected area of a normal crystalline silver chlorobromide grain having a cubic or projected cubic form. The content of silver chlorobromide grains of this invention with respect to the total silver halide grain content of the same emulsion layer is preferably at least 70 mol. %, more preferably at least 90 mol. %, and most preferably at least 100 mol. %.

The average grain size (the grain diameter in the case of spherical grains or grains which approach a spherical form or the length of an edge in the case of cubic grains is taken for the grain size, the average being expressed on the basis of the projected areas) of the silver halide grains in the photographic emulsion is not critical, but it is preferably not more than 2 μm and, particularly desirably, it is within the range from 0.2 to 1.5 μm.

The silver halide grains in the photographic emulsion layer may have a regular crystalline form, such as a cubic, tetradecahedral or octahedral form, (being a regular crystalline emulsion), or they may have an irregular crystalline form, such as a spherical or tarbular form, or they may have a composite form consisting of these various crystalline forms. The silver halide grains may also take the form of mixtures of grains which have various crystalline forms. Of these, the use of the aforementioned regular crystalline emulsions is preferred.

Emulsions having tabular silver halide grains wherein the diameter is at least 5 times the thickness and which accounts for at least 50 mol. % of the total projected area can also be used.

The silver halide emulsion which is included in at least one photosensitive layer is a mono-disperse emulsion of which the variation coefficient (the value obtained by dividing the statistical standard deviation by the average grain size expressed as a percentage) is preferably not more than 15% (and more desirably not more than 10%).

Mono-disperse emulsions of this type may be independent emulsions which have a variation coefficient as mentioned above, but they may also be emulsions in which two or more mono-disperse emulsions which have been prepared separately wherein the average particle size of each emulsion has a variation coefficient of not more than 15% (and preferably not more than 10%) are mixed together. The difference in particle size and the mixing ratio is not critical, but the use of emulsions which have an average grain size difference within the range from at least 0.2 μm but not more than 1.0 μm is preferred.

Variation coefficients and methods for its measurement, are described by T.H. James, "The Theory of the Photographic Process", Third Edition, page 39, published by the Macmillan Publishing Co. (1966).

The silver halide grains may have a different phase for the interior part and surface layers. Furthermore, they may be of the type in which the latent image is formed principally at the surface of the grains or of the type in which the latent image is formed principally within the grains. Grains of the latter type are especially useful for direct positive emulsions.

Cadmium salts, zinc salts, thallium salts, lead salts, irridium salts or complex salts thereof, rhodium salts or complex salts thereof, iron salts or complex salts thereof etc. may also be present during the formation or physical ripening process of the silver halide grains.

Silver halide emulsions are normally subjected to chemical sensitization. Usual methods of chemical sensitization as used here, have been disclosed in JP-A-62-215272.

Moreover, the use of the red photosensitive sensitizing dyes represented by the aforementioned general formulae (III), (IV) and (V) is preferred in the silver halide emulsions of this invention.

In the aforementioned general formulae (III) and (IV), the alkyl group represented by R is a methyl group, an ethyl group or a propyl group, and R preferably represents a hydrogen atom, a methyl group or an ethyl group. Most desirably, R represents a hydrogen atom or an ethyl group.

Furthermore, $R_7$, $R_8$, $R_9$ and $R_{10}$ each represents a group selected from among the linear and branched chain alkyl groups (which may have substituent groups including a methyl group, ethyl group, propyl group, chloroethyl group, hydroxyethyl group, methoxyethyl group, acetoxyethyl group, carboxymethyl group, carboxyethyl group, ethoxycarbonylmethyl group, sulfoethyl group, sulfopropyl group, sulfobulyl group, β-hydroxy-γ-sulfopropyl group, propylsulfate group, ally group, benzyl group etc.), or the aryl groups (which may also have substituent groups including a phenyl group, carboxyphenyl group, sulfophenyl group etc.), and the heterocyclic rings which are formed by $Z_1$, $Z_2$, $Z_4$ and $Z_5$ may also have substituent groups, the preferred substituent groups in this case are halogen atoms, aryl groups, alkyl groups or alkoxy groups, and the more desirable substituent groups are halogen atoms (for example, chlorine atom), phenyl group, methyl group and methoxy group.

X represents an anion (for example $Cl^-$, $Br^-$, $I^-$,

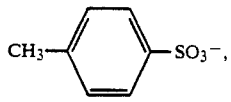

$CH_3SO_4^-$, $C_2H_3SO_4^-$, etc.) and l represents 1 or 2.

However, l represents the integer 1 when the compound forms an intramolecular salt.

In general formula (V), $R_{11}$ and $R_{12}$ each represents an alkyl group (which has from 1 to 10, and preferably from 1 to 5, carbon atoms; for example a methyl group, ethyl group, 3-propyl group, 4-butyl group, 3-butyl group, 5-pentyl group etc.), a substituted alkyl group (which has from 1 to 10, and preferably from 1 to 5, carbon atoms, for example an alkyl group which contains a sulfo group, preferably one which has an alkyl radical (moiety) which has from 1 to 4 carbon atoms (for example, a sulfoalkyl group (2-sulfoalkyl group, 3-sulfopropyl group, 3-sulfobutyl group, 4-sulfobutyl group etc.), an alkyl group which is substituted with a hydroxy group, acetoxy group or an alkoxy group (of which the alkyl radical preferably has from 1 to 4 carbon atoms) and a sulfo group, (for example 2-hydroxy-3-sulfopropyl group, 2-(3-sulfopropoxy)ethyl group, 2-acetoxy-3-sulfopropyl group, 3-methoxy-2-(3-sulfopropoxy)propyl group, 2-[2-(3-sulfopropoxy)ethoxy]ethyl group, 2-hydroxy-3-(3'-sulfopropoxy)propyl group etc.), a sulfoaralkyl group (for example a p-sulfophenethyl group, p-sulfobenzyl group etc.) etc.), an alkyl group which contains a carboxyl group of which the alkyl radical (moiety) preferably has from 1 to 4 carbon atoms (for example a carboxyethyl group, 2-carboxyethyl group, 3-carboxypropyl group, 2-(2-carboxyethoxy ethyl group, p-carboxybenzyl group etc.), an aralkyl group (for example benzyl group, phenethyl group, phenylpropyl group, phenylbutyl group), an alkyl substituted aralkyl group (for example p-methylphenethyl group, p-tolylpropyl group etc.), an alkoxy substituted aralkyl group (for example a p-methoxyphenethyl group etc.), a halogen substituted aralkyl group (for example a p-chlorophenethyl group, m-chlorophenethyl group, etc.) etc.), an aryloxyalkyl group (for example a phenoxyethyl group, phenoxypropyl group, phenoxydibutyl group), an alkyl or alkoxy substituted aryloxyalkyl group (for example a p-methylphenoxyethyl group, p-methoxyphenoxypropyl group etc), an aryl group which preferably has from 4 to 15 carbon atoms (for example, a phenyl group, pyridyl group etc.), a substituted aryl group of which the aryl part preferably has from 4 to 15 carbon atoms, and on which the substituent group used for the substituted alkyl groups form the substituent groups (for example, p-methylphenyl group, p-methoxyphenyl group etc.), or an allyl group.

At least one of $R_{11}$ and $R_{12}$ represents an alkyl group which contains a sulfo group or an alkyl group which contains a carboxyl group.

$R_{13}$ and $R_{14}$ each represents alkyl groups (which preferably have from 1 to 5 carbon atoms, for example; methyl group, ethyl group, propyl group etc.).

$Z_6$ represents a group of non-metal atoms which is required to complete, together with the nitrogen atom, a five or six membered nitrogen containing heterocyclic nucleus, and the said nucleus may be, for example, a thiazole nucleus (for example; a thiazole nucleus, 4-methylthiazole nucleus, 4-phenylbenzothiazole nucleus, 4,5-dimethylthiazole nucleus, 4,5-diphenylthiazole nucleus, benzothiazole nucleus, 4-chlorobenzothiazole nucleus, 5-chlorobenzothiazole nucleus, 6-chlorobenzothiazole nucleus, 7-chlorobenzothiazole nucleus, 4-methylbenzothiazole nucleus, 5-methylbenzothiazole nucleus, 6-methylbenzothiazole nucleus, 5-bromobenzothiazole nucleus, 6-bromobenzothiazole nucleus, 5-iodobenzothiazole nucleus, 5-phenylbenzothiazole nucleus, 5-methoxybenzothiazole nucleus, 6-methoxybenzothiazole nucleus, 5-ethoxybenzothiazole nucleus, 5-carboxybenzothiazole nucleus, 5-ethoxycarbonylbenzothiazole nucleus, 5-phenethylbenzothiazole nucleus, 5-fluorobenzothiazole nucleus, 5-tri-fluoromethylbenzothiazole nucleus, 5,6-dimethylbenzothiazole nucleus, 5-hydroxy-6-methylbenzothiazole, nucleus, tetrahydrobenzothiazole nucleus, 4-phenylbenzothiazole nucleus, naphtho[2,1-d]thiazole nucleus, naphtho[1,2-d]thiazole nucleus, naphtho[2,3-d]thiazole nucleus, 5-methoxynaphtho[1,2-d]thiazole nucleus, 7-ethoxynaphtho[2,1-d]thiazole nucleus, 8-methoxynaphtho[2,1-d]thiazole nucleus, 5-methoxynaphtho-2,3-d]thiazole nucleus etc.), a selenazole nucleus (for example a 4-methylsenenazole nucleus, 4-phenylselenazole nucleus, benzoselenazolenucleus, 5-chlorobenzoselenazole nucleus, 5-methoxybenzoselenazole nucleus, 5-methylbenzoselenazole nucleus, 5-hydroxybenzoselenazole nucleus, naphtho[2,1-d]selenazole nucleus, naphtho[1,2-d]selenazole nucleus etc.), an oxazole nucleus (for example an oxazole nucleus, 4-methyloxazole nucleus, 4-ethyloxazole nucleus, 5-methyloxazole nucleus, 4-phenyloxazole nucleus, 4,5-diphenyloxazole nucleus, benzoxazole nucleus, 5-chlorobenzoxazole nucleus, 5-methylbenzoxazole nucleus, 5-bromobenzoxazole nucleus, 5-fluorobenzoxazole nucleus, 5-phenylbenzoxazole nucleus, 5-methoxybenzoxazole nucleus, 5-trifluoromethylbenzoxazole nucleus, 5-hydroxybenzoxazole nucleus, 5-carboxybenzoxazole nucleus, 6-methylbenzoxazole nucleus, 6-chlorobenzoxazole nucleus, 6-methoxybenzoxazole nucleus, 6-hydroxybenzoxazole nucleus, 5,6-dimethylbenzoxazole nucleus, 4,6-dimethylbenzoxazole nucleus, 5-ethoxybenzoxazole nucleus, naphtho[2,1-d]oxazole nucleus, naphtho[1,2-d]oxazole nucleus, naphtho[2,3-d]oxazole nucleus etc.), a quinoline nucleus (for example 2-quinoline nucleus, 3-methyl-2-quinoline nucleus, 5-ethyl-2-quinoline nucleus, 6-methyl-2-quinoline nucleus, 8-fluoro-2-quinoline nucleus, 6-methoxy-2-quinoline nucleus, 6-hydroxy-2-quinoline nucleus, 8-chloro-2-quinoline nucleus, 8-fluoro-4-quinoline nucleus etc.), a 3,3-dialkyl indolenine nucleus (for example a 3,3-dimethylindolenine nucleus, 3,3-diethylindolenine nucleus, 3,3-dimethyl-5-cyanoindolenine nucleus, 3,3-dimethyl-5-methoxyindolenine, 3,3-dimethyl-5-methylindolenine nucleus, 3,3-dimethyl-5-chloroindolenine nucleus etc.), an imidazole nucleus (for example a 1-methylimidazole nucleus, 1-ethylimidazole nucleus, 1-methyl-4-phenylimidazole nucleus, 1-phenylimidazole nucleus, 1-ethyl-4-phenylimidazole nucleus, 1-methyl-benzimidazole nucleus, 1-ethylbenzimidazole nucleus, 1-methyl-5-chlorobenzimidazole nucleus, 1-ethyl-5-chlorobenzimidazole nucleus, 1-methyl-5,6-dichlorobenzimidazole nucleus, 1-ethyl-5,6-dichlorobenzimidazole nucleus, 1-alkyl-5-methoxybenzimidazole nucleus, 1-methyl-5-cyanobenzimidazole nucleus, 1-ethyl-5-cyanobenzimidazole nucleus, 1-methyl-5-fluorobenzimidazole nucleus, 1-ethyl-5-fluorobenzimidazole nucleus, 1-phenyl-5,6-dichlorobenzimidazole nucleus, 1-allyl-5,6-dichlorobenzimidazole nucleus, 1-allyl-5-chlorobenzimidazole nucleus, 1-phenylbenzimidazole nucleus, 1-phenyl-5-chlorobenzimidazole nucleus, 1-methyl-5-trifluoromethylbenzimidazole nucleus, 1-ethyl-5-trifluoromethylbenzimidazole nucleus, 1-ethylnaphtho[1,2-d]imidazole nucleus etc.), a pyridine nucleus (for example a pyridine nucleus, 5-methyl-2-pyridine nucleus, 3-methyl-4-pyridine nucleus etc.) etc. Of these, the use of the thiazole nuclei and the oxazole nuclei is preferred. Use of the benzothiazole nucleus, the naphthothiazole nucleus and the naphthoxazole nucleus is more preferred.

The sensitizing dyes represented by the general formulae (III), (IV) and (V) can be readily synthesized using the methods described, for example, by F.M. Hermer in *The Chemistry of Heterocyclic Compounds*, Volume 18, and in *The Cyanine Dyes and Related Compounds* (A. Welsaberger, published by Interscience, New York, 1964).

Typical examples of the sensitizing dyes which can be used in the invention are indicated below, but the compounds which can be used in the invention are not limited to these examples.

S-1

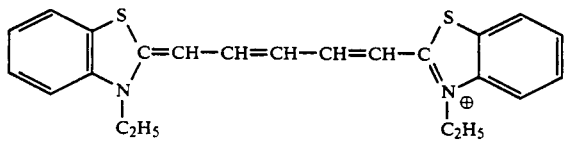

$I^{\ominus}$

S-2

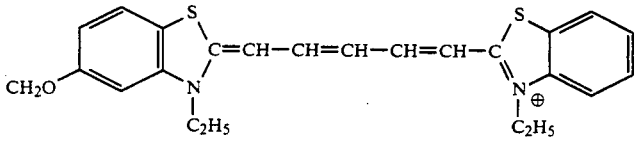

$I^{\ominus}$

S-3

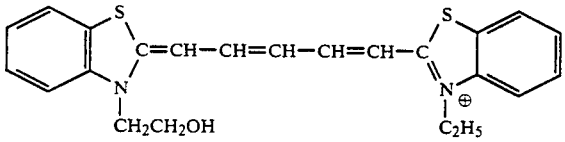

$I^{\ominus}$

S-4

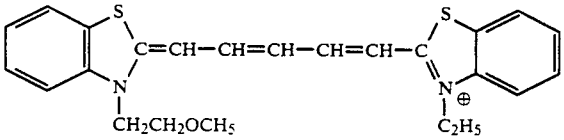

$Br^{\ominus}$

S-5

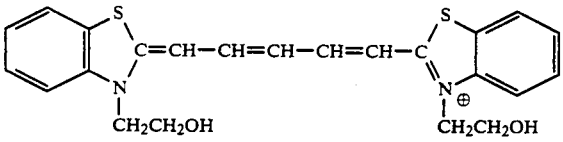

$Br^{\ominus}$

S-6

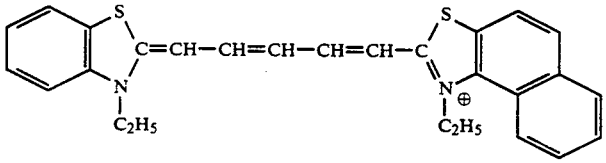

$Br^{\ominus}$

S-7

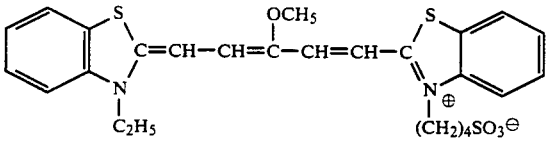

-continued
S-8
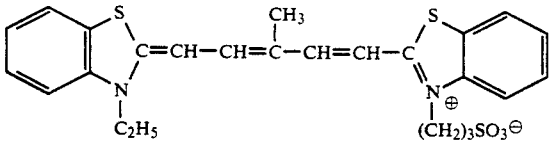
S-9
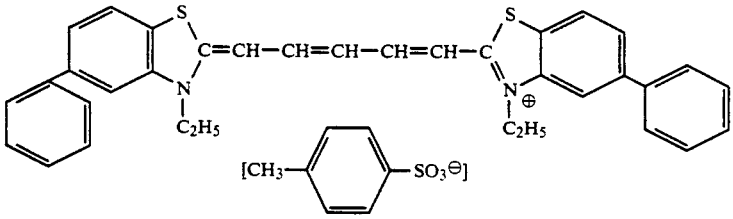
S-10
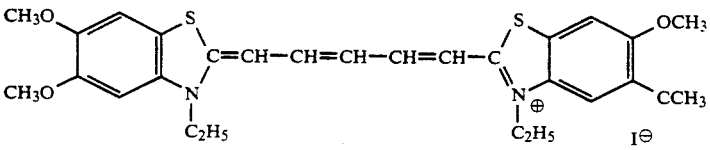
S-11
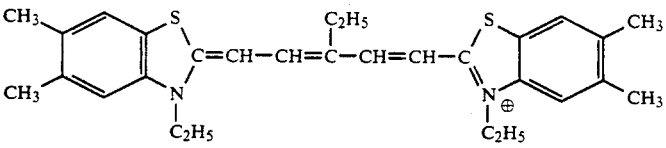
S-12
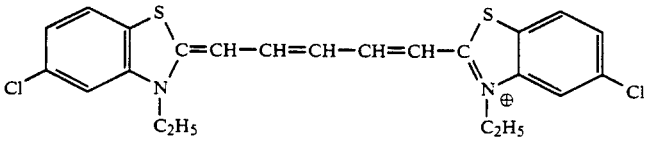
S-13
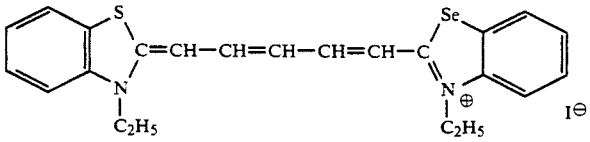
S-14
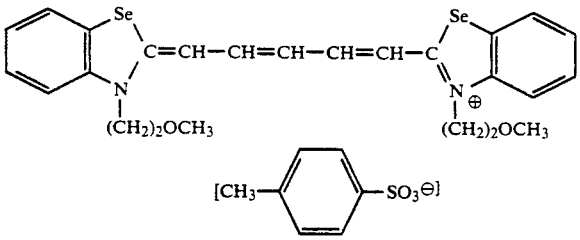
S-15
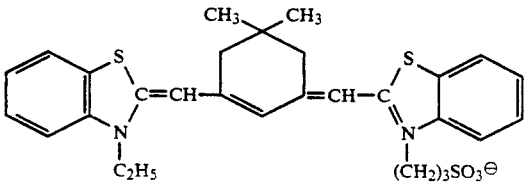
S-16
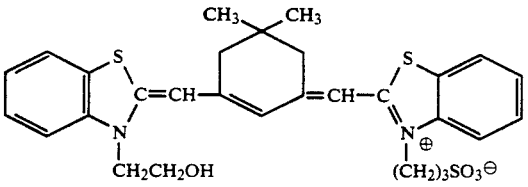

-continued
S-17
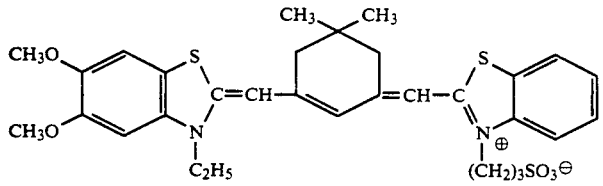
S-18
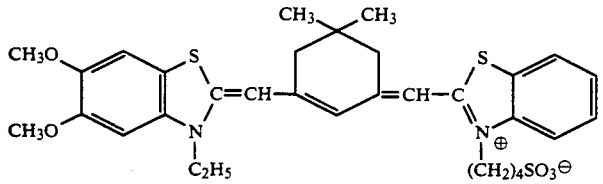
S-19
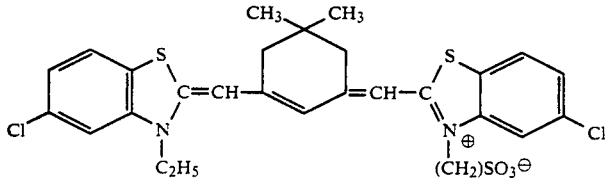
S-20
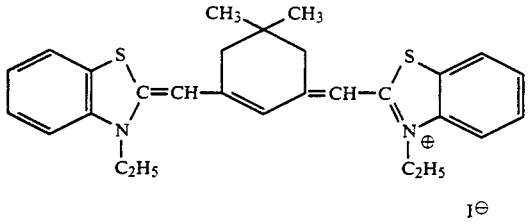
S-21
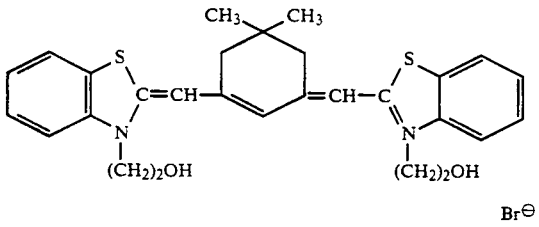
S-22
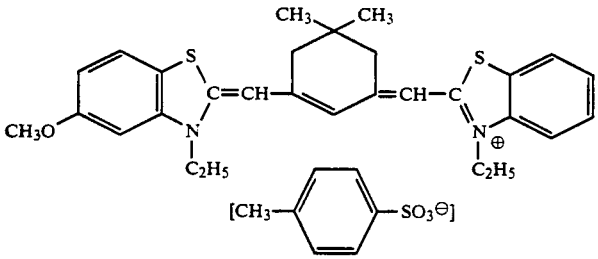
S-23
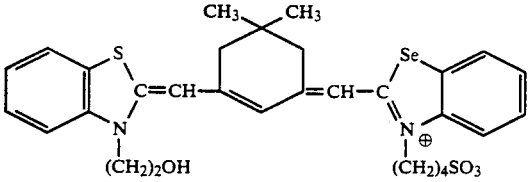

-continued
S-24
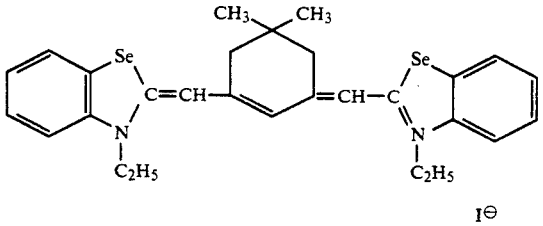
S-25
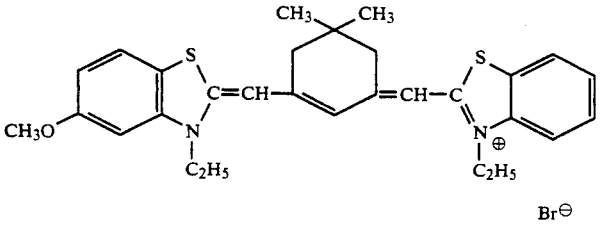
S-26
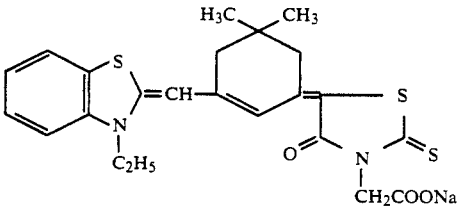
S-27
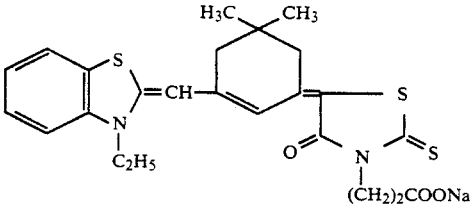
S-28
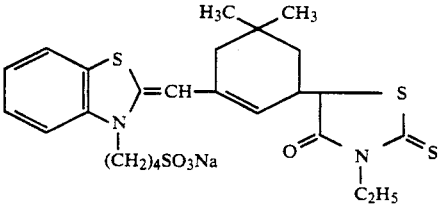
S-29
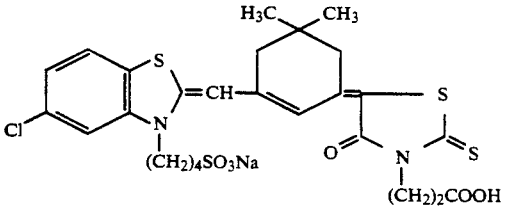
S-30
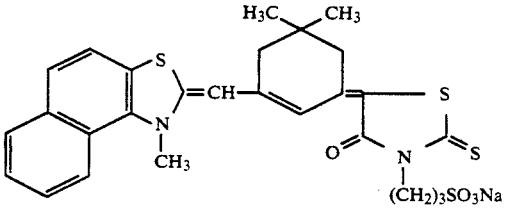

-continued
S-31
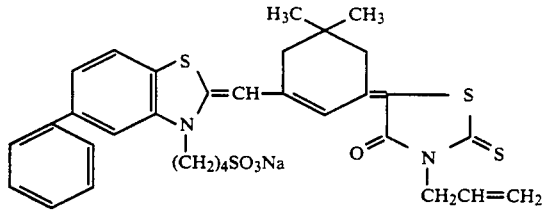
S-32
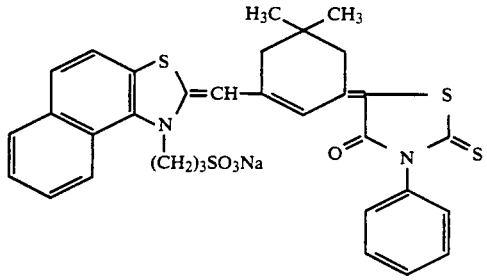
S-33
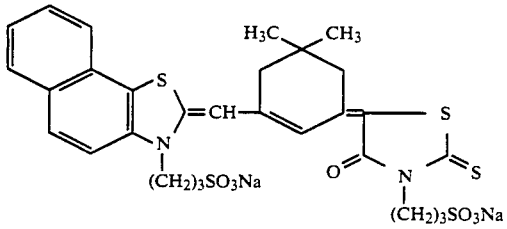
S-34
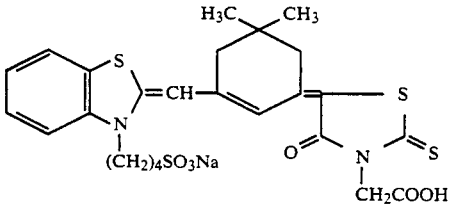
S-35
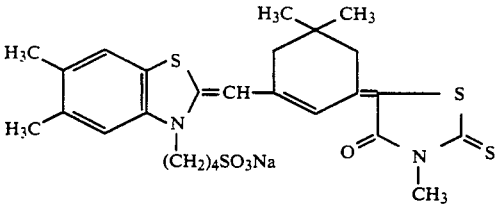
S-36
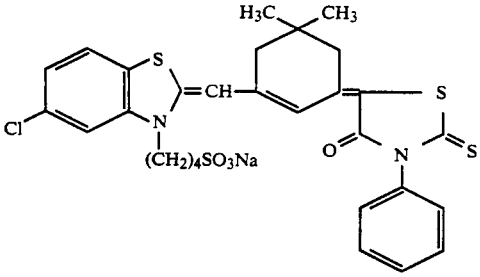
S-37
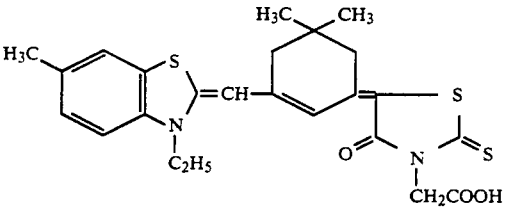

-continued
S-38
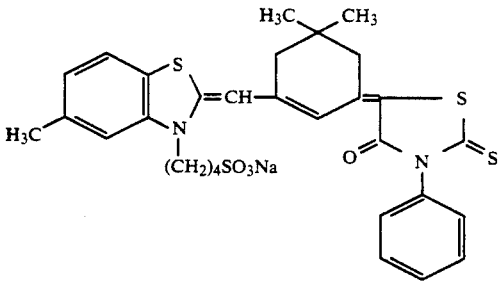
S-39
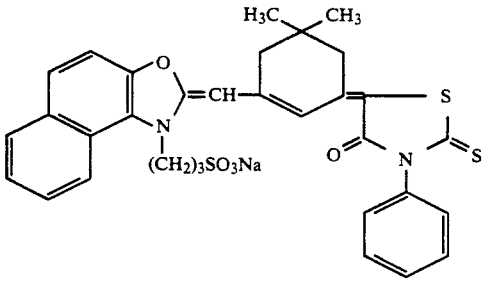
S-40
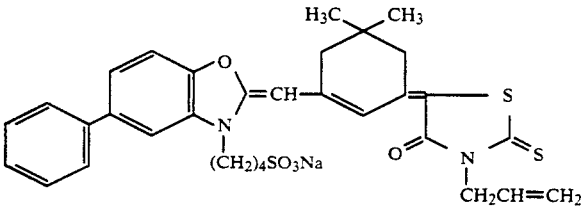
S-41
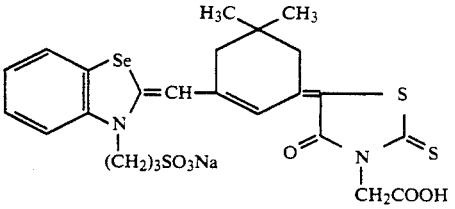
S-42
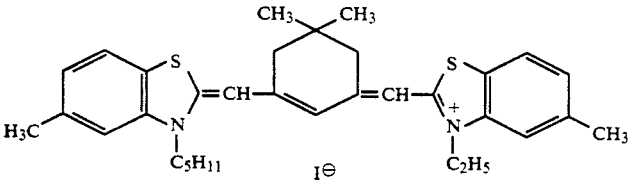
S-43
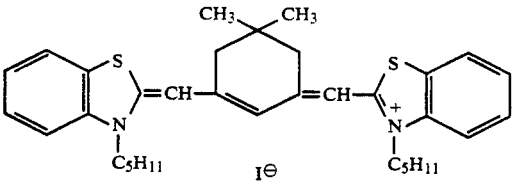
S-44
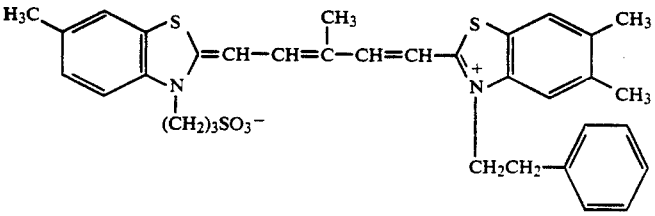

-continued

S-45

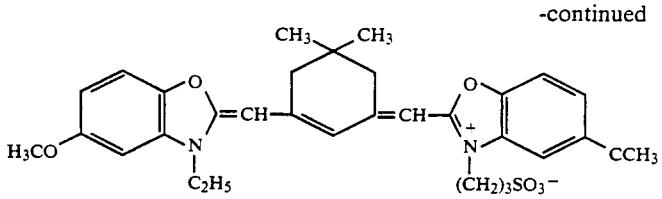

S-46

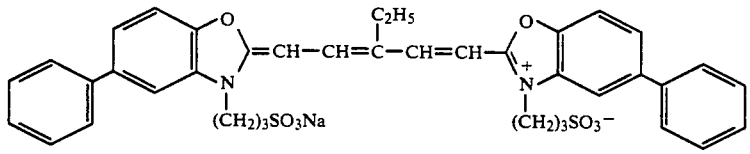

S-47

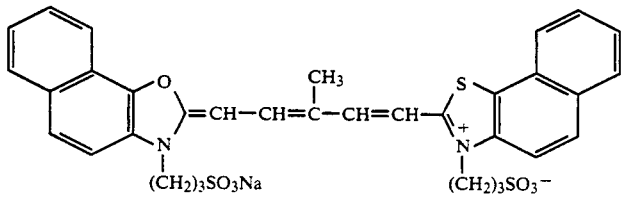

S-48

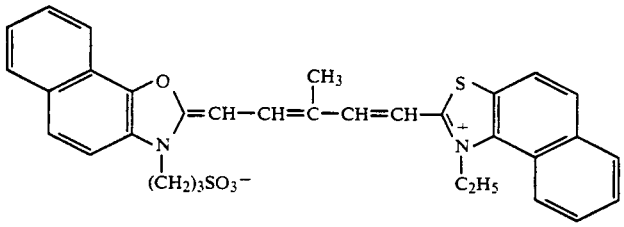

S-49

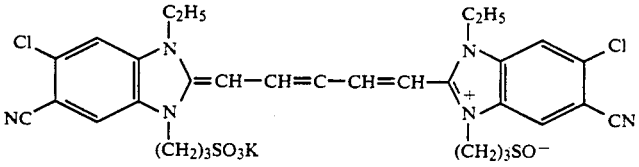

S-50

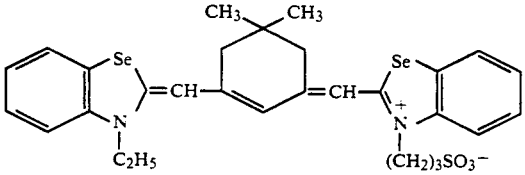

S-51

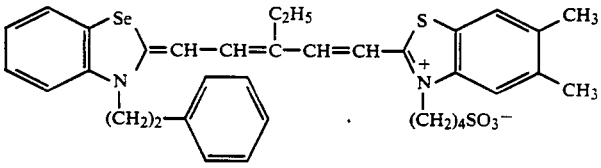

The optimum concentration of the sensitizing dyes represented by general formulae (III), (IV) and (V) can be determined using methods well known in the industry. For example, the optimum concentration can be determined by dividing a certain emulsion into portions, including the sensitizing dyes therein at different concentrations followed by measuring the speed of each emulsion.

The amount of sensitizing dye used in this invention is not critical, but the use of an amount within the range from $2\times10^{-6}$ mol to $1\times10^{-3}$ mol per mol of silver halide is preferred, and the use of an amount within the range from $5\times10^{-5}$ mol to $5\times10^{-4}$ mol per mol of silver halide is more preferred.

Methods are well known in the industry for adding the sensitizing dye to the emulsion. For example, these sensitizing dyes can be dispersed directly in the emulsion, or they can be dissolved in a water soluble solvent such as pyridine, methyl alcohol, ethyl alcohol, methyl cellulose, acetone, or a mixture of such solvents, or such a solvent may be diluted with water, or alternatively they may be dissolved in water, and they may be added to the emulsion in the form of a solution of this type. Ultrasonic vibration can be used in the dissolution process. Furthermore, the dyes can be dissolved in a volatile organic solvent and the solution can be dispersed in a hydrophilic colloid which is then added to the emulsion, as described in U.S. Pat. No. 3,469,987 etc., or the dye can be dispersed in a water soluble solvent which does not dissolve the water insoluble dye and this dispersion may be added to the emulsion as described in JP-B-46-24185. Furthermore, the dye can be added to the emulsion in the form of a dispersion obtained using an acid dissolution and dispersion method. The methods described in U.S. Pat. Nos. 2,912,345, 3,342,605, 2,996,287 and 3,425,835 etc. can also be used for adding the dye to the emulsions.

The sensitizing dyes represented by general formulae (III), (IV) and (V) may be added to the emulsion any time during the preparation of the emulsion, and the sensitizing dyes may be divided into portions which may be added at different times.

Furthermore, the sensitizing dyes represented by the general formulae (III), (IV) and (V) can be combined with other sensitizing dyes and can then be used as supersensitizing composition.

In the case of supersensitizing compositions, the respective sensitizing dyes may be dissolved in the same or different solvents and the solutions so obtained can be mixed together before being added to the emulsion or they can be added to the emulsion separately. When added separately, the order of the addition and the time intervals are set according to the intended purpose.

Moreover, at least one of the sensitizing dyes represented by formulae (III), (IV) and (V) which are used in the invention can be used in any combination (i.e., (III) and (IV), (III) and (V), (IV) and (V), and (III) and (IV) and (V)). Dyes which themselves have no spectrally sensitizing action and super-sensitizing agents which have essentially no absorption in the visible region but which reinforce the sensitizing action of spectrally sensitizing dyes can also be included along with the spectrally sensitizing dyes.

In this invention, the aminostilbene based compounds which are substituted with nitrogen containing heterocyclic groups (for example those described in U.S. Pat. Nos. 2,993,390 and 3,635,721) are useful for reducing the residual coloration of the aforementioned carbocyanine dyes having an oxazole nucleus and for increasing the color sensitivity of the dicarbocyanine dyes having a benzothiazole nucleus or a benzoxazole nucleus. The conjoint use of these compounds is especially preferred. Furthermore, azaindene compounds, especially hydroxyazaindene compounds, are also desirable for increasing color sensitivity.

4,4'-Bis(s-triazinylamino)stilbene-2,2'-disulfonic acid and 4,4'-bis(pyridinylamino)stilbene-2,2'-disulfonic acid, and the alkali metal salts of these compounds, etc. are the preferred aminostilbene compounds for use in the present invention. The s-triazine or pyrimidine rings of these compounds are preferably substituted in one or two positions with substituted or unsubstituted arylamino groups, substituted or unsubstituted alkylamino groups, substituted or unsubstituted aryloxy groups, substituted or unsubstituted alkyloxy groups, or hydroxyl groups or amino groups. The substitution of these parts with substituent groups which are highly water soluble is desirable for reducing residual coloration. Examples of substituent groups which have high water solubility include those substituent groups which contain sulfo or hydroxyl groups.

These compounds can be represented by the general formula (F) as indicated below.

General Formula (F)

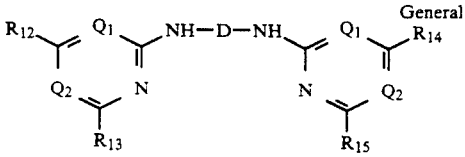

where D represents a divalent aromatic residual group, and $R_{12}$, $R_{13}$, $R_{14}$ and $R_{15}$ each represent a hydrogen atom, hydroxyl group, alkoxy group, aryloxy group, halogen atom, heterocyclic group, mercapto group, alkylthio group, arylthio group, heterocyclylthio group, amino group, alkylamino group, cyclohexylamino group, arylamino group, heterocyclylamino group, aralkylamino group or an aryl group.

$Q_1$ and $Q_2$ each represents a —N= group or a —C= group. However, at least one of $Q_1$ and $Q_2$ is a —N= group.

Illustrative compounds the use of which is preferred in the present invention are listed below.

(F-1)

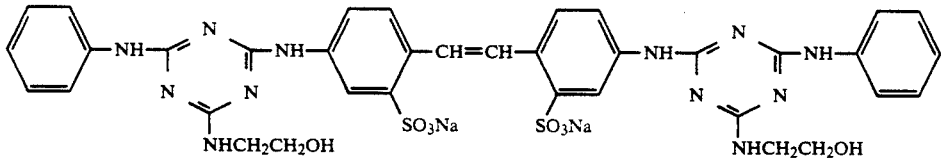

(F-2)

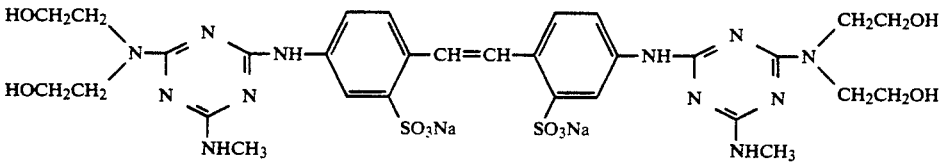

(F-3)

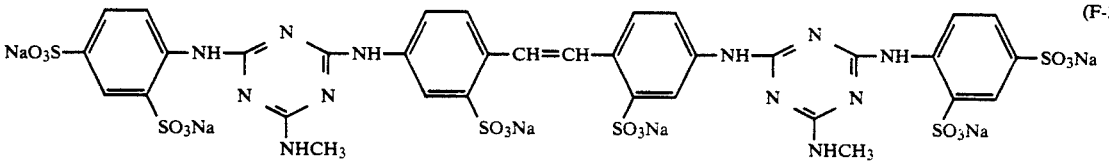

-continued
(F-4)
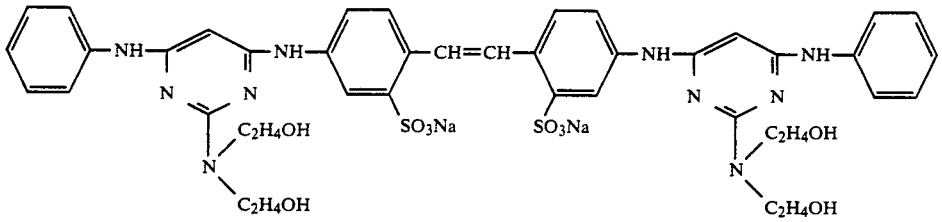
(F-5)
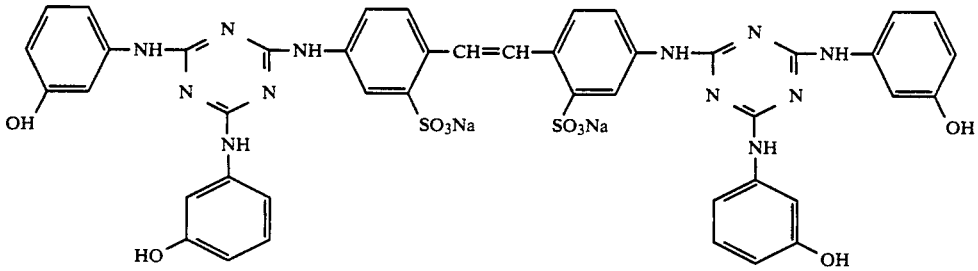
(F-6)
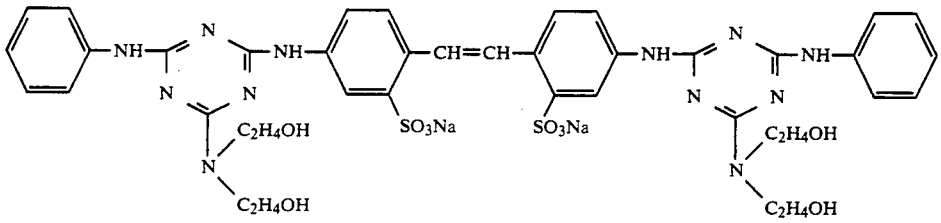
(F-7)
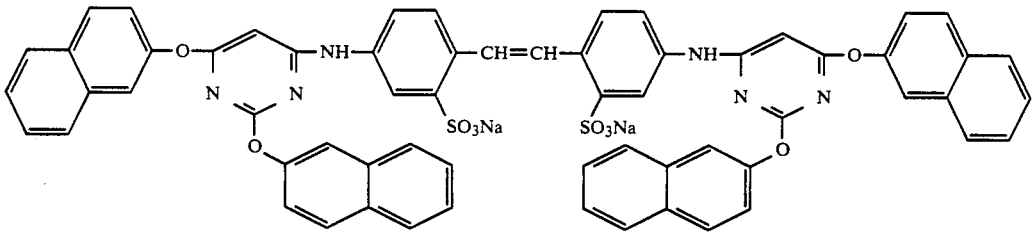
(F-8)
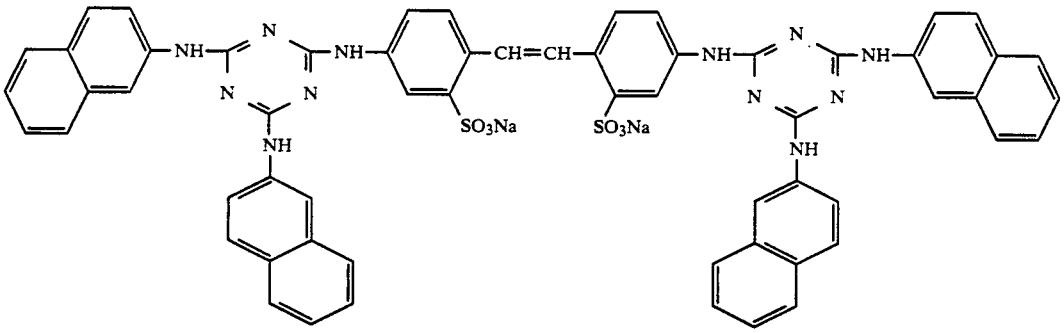
(F-9)
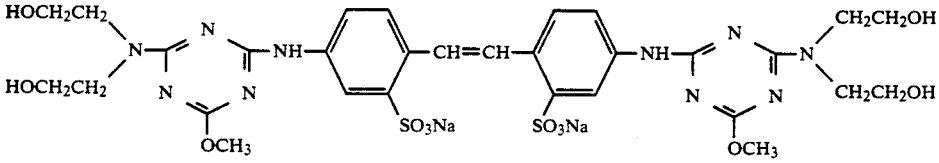

-continued
(F-10)
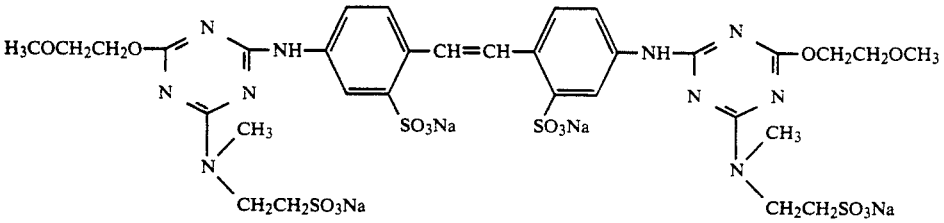
(F-11)
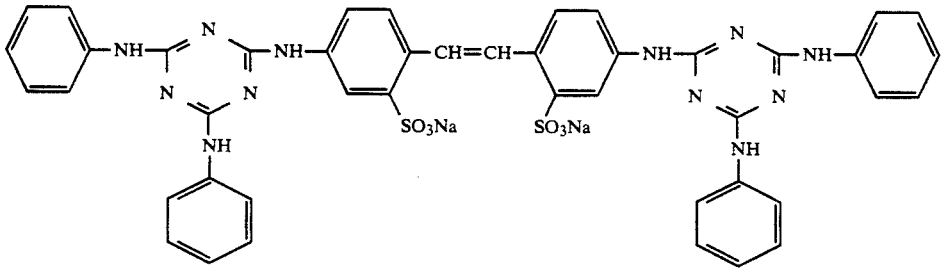
(F-12)
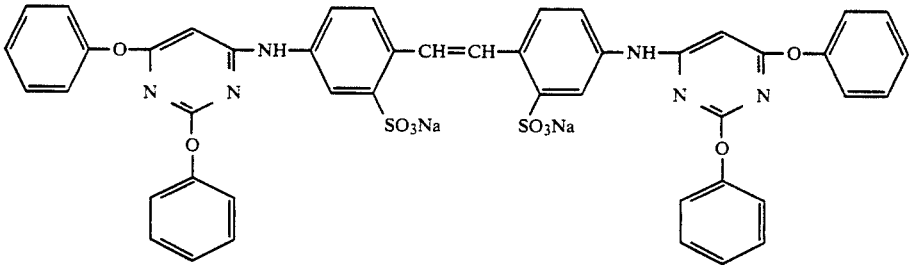
(F-13)
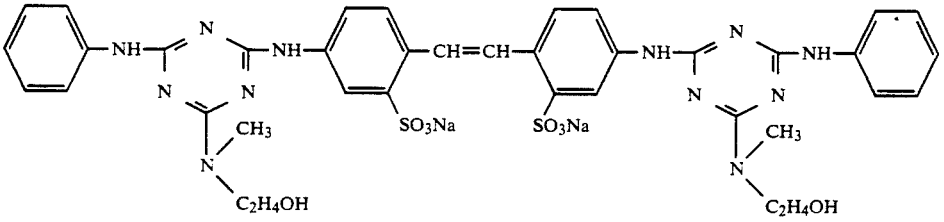
(F-14)
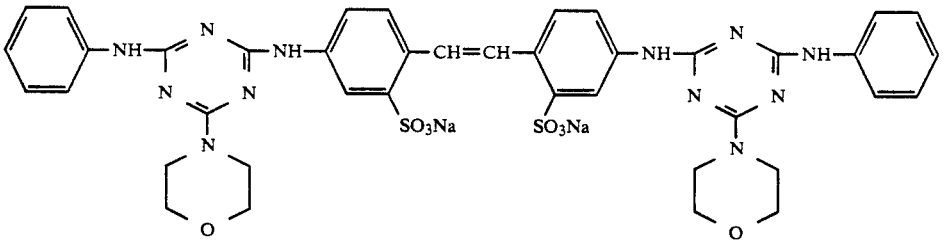
(F-15)
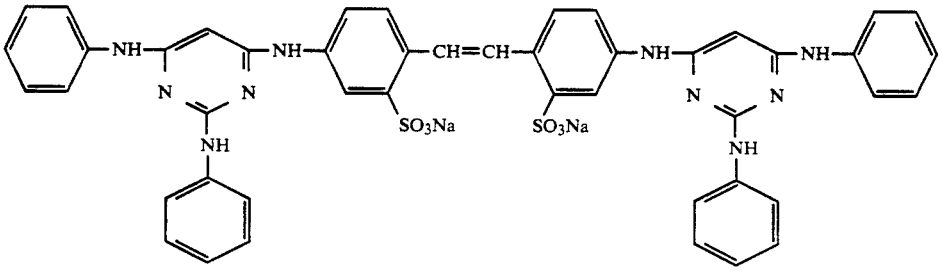

-continued
(F-16)
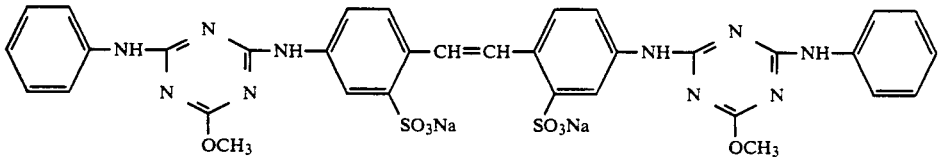
(F-17)
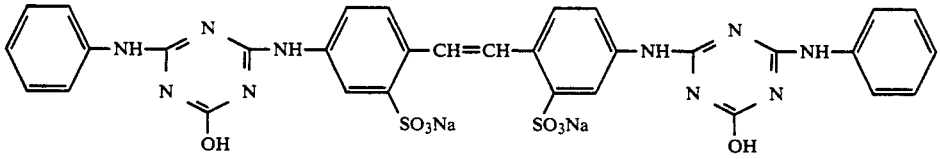
(F-18)
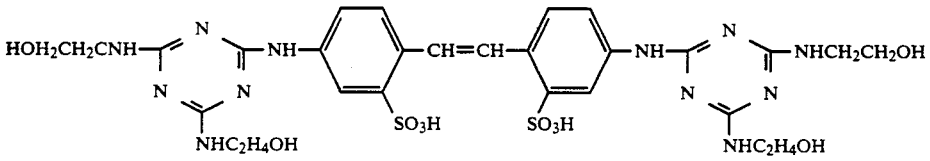
(F-19)
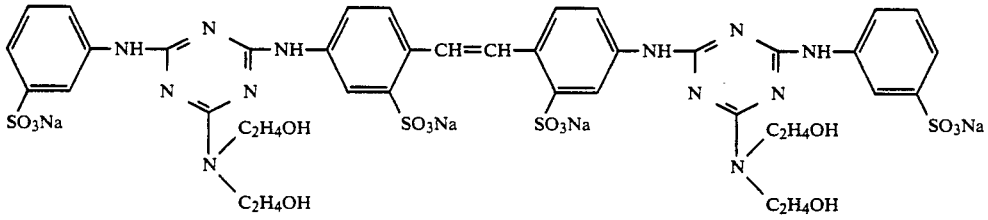
(F-20)
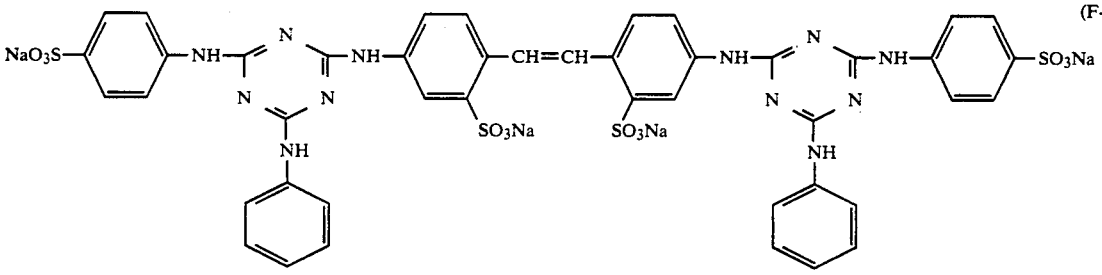
(F-21)
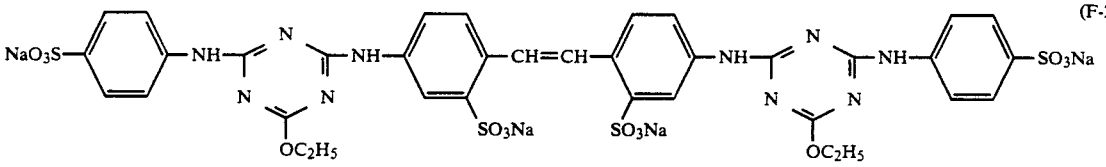
(F-22)
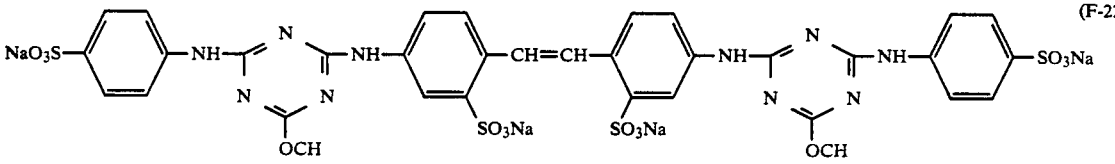
(F-23)
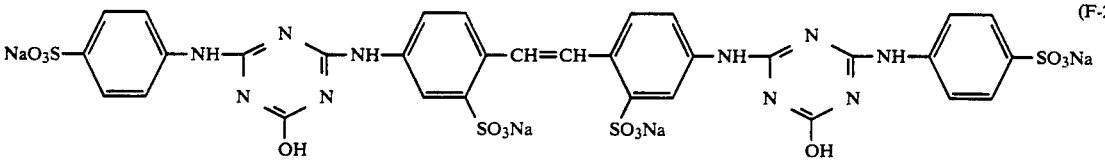

-continued

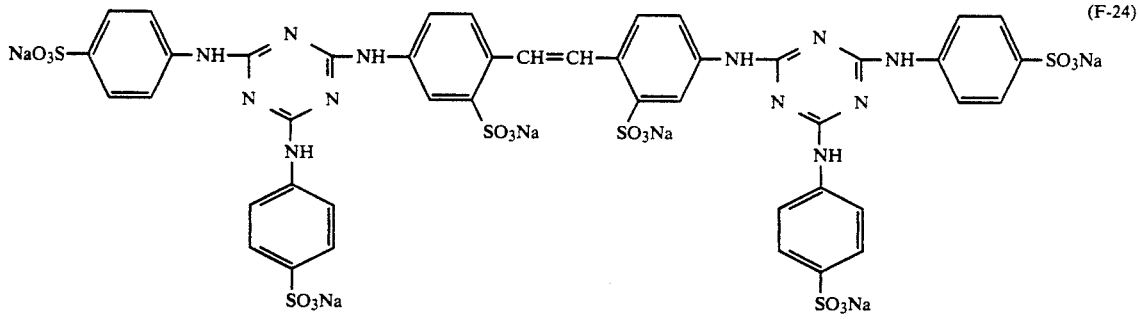

(F-24)

Methine dyes can be used for the spectral sensitization of the other photosensitive layers as given in JP-A-62-215272 and on separate page (B) of the Procedural Amendment dated Mar. 16, 1987 attached thereto.

Various compounds can be included in the photographic emulsions of the present invention in order to prevent fogging during the manufacture, storage or photographic processing of the photosensitive materials or to stabilize photographic performance. Thus, many compounds recognized as anti-fogging agents or stabilizers, such as azoles, for example benzothiazolium salts, nitroimidazoles, nitrobenzimidazoles, chlorobenzimidazoles, bromobenzimidazoles, mercaptothiazoles, mercaptobenzothiazoles, mercaptobezimidazole, mercaptothiadiazoles, aminotriazoles, benzotriazoles nitrobenzotriazoles, mercaptotetrazoles (especially 1-phenyl-5-mercaptotetrazole etc.), mercaptopyrimidines; mercaptotriazines etc; thioketone compounds such as, for example, oxazolinethione; azaindenes, for example, tri-azaindenes, tetraazaindenes (especially 4-hydroxy substituted (1,3,3a,7)tetraazaindene), pentaazaindenes etc; benzenethiosulfonic acid, benzenesulfinic acid, benzensulfonic acid amide etc., can be added for this purpose.

The photosensitive materials of this invention may contain hydroquinone derivatives, aminophenol derivatives, amines, gallic acid derivatives, catechol derivatives, ascorbic acid derivatives, colorless couplers, sulfonamidophenol derivatives etc. as anti-color fogging agents or anti-color mixing agents.

Various anti-color fading agents can also be used in the photosensitive materials of this invention. Examples of organic, anti-color fading agents which can be used for cyan, magenta and yellow images include hydroquinones, 6-hydroxychromans, 5-hydroxycoumarans, spirochromans, p-alkoxyphenols, hindered phenols centered on the bisphenols, gallic acid derivatives, methylenedioxybenzenes, aminophenols, hindered amines and ether and ester derivatives in which the phenolic hydroxyl groups of these compounds have been silylated or alkylated. Furthermore, metal complexes typified by the (bissalicylaldoxymato)nickel complex and the (bis-N,N-dialkyldithiocarbamato)nickel complex can be used for this purpose.

Actual examples of organic anti-color fading agents have been disclosed in the following patents:

Hydroquinones have been disclosed in U.S. Pat. Nos. 2,360,290, 2,418,613, 2,700,453, 2,701,197, 2,728,659, 2,732,300, 2,735,765, 3,982,944 and 4,430,425, in British Patent 1,363,921, and in U.S. Pat. Nos. 2,710,801 and 2,816,028 etc., 6-hydroxychromans, 5-hydroxycoumarans and spirochromans have been disclosed in U.S. Pat. Nos. 3,432,300, 3,573,050, 3,574,627, 3,698,909 and 3,764,337, and in JP-A-52-152225 etc., spiroindanes have been disclosed in U.S. Pat. No. 4,360,589, p-alkoxyphenols have been disclosed in U.S. Pat. No. 2,735,765, in British Patent 2,066,975, in JP-A-59-10539, and in JP-B-57-19764 etc., hindered phenols have been disclosed in U.S. Pat. No. 3,700,455, in JP-A-52-72225, in U.S. Pat. No. 4,228,235, and in JP-B-52-6623, etc., gallic acid derivatives, methylenedioxybenzenes and aminophenols have been disclosed in U.S. Pat. Nos. 3,457,079 and 4,332,886, and in JP-B-56-21144 respectively, hindered amine have been disclosed in U.S. Pat. Nos. 3,336,135 and 4,268,593, in British Patents 1,326,889, 1,354,313 and 1,410,846, in JP-B-51-1420, and in JP-A-58-114036, JP-A-59-53846 and JP-A-59-78344, etc., ether and ester derivatives of phenolic hydroxyl groups have been disclosed in U.S. Pat. Nos. 4,155,765, 4,174,220, 4,254,216 and 4,264,720, in JP-A-54-145530, JP-A-55-6321, JP-A-58-105147 and JP-A-59-10539, in JP-B-57-37856, in U.S. Pat. No. 4,279,990, and in JP-B-53-3263 etc., and metal complexes have been disclosed in U.S. Pat. Nos. 4,050,938 and 4,241,155, and in British Patent 2,027,731A etc. These compounds can be used to achieve the intended purpose by co-emulsification with the couplers and addition to the photosensitive layer, normally at an amount of from 5 to 100 wt. % with respect to the corresponding coupler. The introduction of ultraviolet absorbers into layers on either side adjacent to the cyan color forming layer is effective for preventing deterioration of the cyan dye image by heat or, more especially, by light.

The use of the spiroindanes and hindered amines etc. from among the above mentioned anti-color fading agents is especially preferred.

Ultraviolet absorbers can be included in the hydrophilic colloid layers of the photosensitive materials of this invention. For example, benzotriazole compounds substituted with aryl groups (as disclosed in U.S. Pat. No. 3,533,794), 4-thiazolidone compounds (as disclosed in U.S. Pat. Nos. 3,314,794 and 3,352,681), benzophenone compounds (disclosed in JP-A-46-2784), cinnamic acid ester compounds (as disclosed in U.S. Pat. Nos. 3,705,805 and 3,707,375), butadiene compounds (as disclosed in U.S. Pat. No. 4,045,229), and benzooxidol compounds (as disclosed in U.S. Pat. No. 3,700,455) can be included as ultraviolet absorbers. Ultraviolet absorbing couplers (for example the α-naphthol based cyan dye forming couplers) or ultraviolet absorbing polymers, etc. can also be used for this purpose. These ultraviolet absorbers may be mordanted into a specified layer.

Water soluble dyes can be included in the hydrophilic colloid layers of the photosensitive materials of this invention as filter dyes or for anti-irradiation or various other purposes. Dyes of this type include oxonol dyes, hemi-oxonol dyes, styryl dyes, merocyanine dyes, cyanine dyes and azo dyes. Of these dyes, the oxonol dyes, hemi-oxonol dyes and merocyanine dyes are useful. Details of useful oxoncl dyes have been described in JP-A-62-215272.

The use of gelatin is convenient as a binding agent or protective colloid in the emulsion layers of the photosensitive materials of this invention, but other hydrophilic colloids can be used either independently or in conjunction with gelatin.

The gelatin used in the present invention may be a lime treated gelatin, or an acid treated gelatin. Details regarding the manufacture of gelatin have been described by Arthur Wiese in "The Macromolecular Chemistry of Gelatin" (published by Academic Press, 1964).

The cellulose nitrate films, cellulose acetate films, cellulose acetate butyrate films, cellulose acetate propionate films, polytyrene films, polyethyleneterephthalate films, polycarbonate films, laminates of these films, thin glass films, paper etc. normally used in photographic materials can be used as the support for use in the present invention. Supports such as papers coated or laminated with baryta or an $\alpha$-olefin polymer, especially a polymer made from an $\alpha$-olefin having from 2 to 10 carbon atoms (for example, polyethylene, polypropylene, ethylene/butene copolymer etc.), vinyl chloride resins which contain reflecting substances such as $TiO_2$ and plastic films of which the adhesion with other polymeric materials has been improved by surface roughening as described in JP-B-47-19068 provide good results. Furthermore, ultraviolet curable resins can be used for this purpose.

A transparent support or a non-transparent support can be selected according to the intended purpose of the photosensitive material. Furthermore, the supports can be rendered colored and transparent by the addition of dyes or pigments.

Apart from conventional non-transparent supports such as paper, non-transparent supports also include those made by adding dyes or organic pigments such as titanium oxide to a transparent film and plastic films which have been surface treated using methods such as those described in JP-B-47-19068, etc. An undercoating layer is normally established on the support. Preliminary surface treatments such as coronal discharge, ultraviolet irradiation and flame treatments, etc. can also be used with these supports in order to improve their adhesion properties.

The color photosensitive materials which can be used for making color photographs according to the method of the present invention may be any of the usual types of color photographic materials including color negative films, color papers, reversal color papers, color reversal films and color positive films, etc.

Color development baths are used for the development processing of the photosensitive materials of this invention. A color development bath preferably consists of an aqueous alkaline solution which contains a primary aromatic amine based color developing agent as a principal component. Aminophenol based compounds are also useful as color developing agents, but the use of p-phenylenediamine based compounds is preferred. Typical examples of these developing compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and the sulfate, hydrochloride and p-toluenesulfonate salts of these compounds. Two or more of these compounds can be used conjointly.

The high silver chloride color photographic materials of this invention are preferably developed in color development baths which contain no water soluble bromide or only a very small amount of water soluble bromide. The rate of development of a high silver chloride content color photographic material falls rapidly when excess water soluble bromide is included and it is not possible to achieve the objectives of the present invention. The bromide ion concentration in the color development bath, calculated as potassium bromide, is generally not more than 0.1 gram, and preferably not more than $8.4\times10^{-4}$ mol, and preferably not more than $4.2\times10^{-4}$ mol per liter of color development bath. In a running processing, a bromide ion of about $5\times10^{-5}$ to $5\times10^{-4}$ mol/l may be contained because it is eluted from a photographic material.

Furthermore, omission of benzyl alcohol from the color development bath is desirable since benzyl alcohol has a high BOD and a high COD; both measures of pollution load. Since benzyl alcohol has a low affinity for water, it is necessary to use diethylene glycol or triethyleneglycol as a solvent. However, the glycols also have a high BOD and COD and the waste processing baths give rise to environmental pollution. Benzyl alcohol has a low solubility for a development bath, a long time is required to prepare a development bath and a replenisher and this imposes an industrial process burden. Furthermore, the replenisher has to be made up more frequently in cases where the replenishment rate is high and this imposes an industrial process burden.

Hence, resolution of the environmental problems and industrial problems as indicated above by essentially eliminating benzyl alcohol from the color development bath is very desirable.

The term "essentially eliminating benzyl alcohol" means that the concentration of benzyl alcohol in the bath is not more than 0.5 ml per liter of development bath. Preferably, no benzyl alcohol at all is included in the development bath.

Essential elimination of sulfite ions in development baths of the present invention which are essentially free of benzyl alcohol is also desirable. Being essentially free of sulfite ion means that the concentration of sulfite ion is not more than $8\times10^{-3}$ mol per liter. Preferably, the sulfite ion concentration not more than $4\times10^{-3}$ mol per liter.

High silver chloride content photosensitive materials which include the polymers of this invention have better color forming properties in color development baths free of benzyl alcohol as compared to those materials which do not contain the polymers of the present invention.

Color development baths generally contain pH buffers such as alkali metal carbonates, borates or phosphates, and development inhibitors or anti-fogging agents such as bromides, iodides, benzimidazoles, benzothiazoles or mercapto compounds etc. They may also contain, as required, various preservatives such as hydroxylamine, diethylhydroxylamine, sulfites, hydrazines, phenylsemicarbazides, triethanolamine, catechol sulfonic acids, triethylenediamine(1,4-diazabicyclo[2,2,-2]octane) etc., development accelerators such as poly(ethylene glycol), quaternary ammonium salts and amines, color forming couplers, competitive couplers, fogging agents such as sodium borohydride, auxiliary developing agents such as 1-phenyl-3-pyrazolidone, viscosity imparting agents, and various chelating agents as typified by the aminopolycarboxylic acids, aminopolyphosphonic acids, alkylphosphonic acids and phosphonocarboxylic acids, typical examples of which include ethylendiamine tetra-acetic acid, nitrilo triacetic acid, diethylenetriamine penta-acetic acid, cyclohexanediamine tetraacetic acid, hydroxyethylimino diacetic acid, 1-hydroxyethylidene-1,1-diphosphonic acid, nitrilo-N,N,N-trimethylenephosphonic acid, ethylenediamine-N,N,N',N'-tetramethylenedphosphonic acid, ethylenediamine di(o-hydroxyphenylacetic acid), and salts of these compounds.

Color development is carried out after standard black and white development in the case of reversal processing. Various black and white developing agents, for example dihydroxybenzenes such as hydroquinone etc., 3-pyrazolidones such as 1-phenyl-3-pyrazolidone etc., and aminophenols such as N-methyl-p-aminophenol etc., can be used individually or in combinations for the black and white development bath.

The pH of these color developers and black and white developers is general within the range from 9 to 12. Furthermore, the replenishment rate of these development baths depends on the color photographic material which is being processed, but it is generally not more than 3 liters per square meter of photosensitive material and it is possible, by reducing the bromide ion concentration in the replenisher, to use a replenishment rate of not more than 500 ml per square meter of photosensitive material. Prevention of the loss of liquid by evaporation and prevention of aerial oxidation by minimizing the contact area of the bath with air is desirable where the replenishment rate is low. Furthermore, the replenishment rate can be reduced by using a means of suppressing the accumulation of bromide ion in the developer.

The photographic emulsion layers of the present invention are subjected to a normal bleaching process after color development. The bleaching process may be carried out at the same time as the fixing process (in a bleach-fix process) or it may be carried out as a separate process. Moreover, a bleach-fix process can be carried out after a bleaching process in order to speed-up processing. Moreover, processing can be carried out in two connected bleach-fix baths. A fixing process can be carried out before the bleach-fix process, or a bleaching process can be carried out after a bleach-fix process according to the intended purpose of the processing. Compounds of a poly-valent metal such as iron(III), cobalt(III), chromium(VI), copper(II) etc., peracids, quinones, nitro compounds etc. can be used as bleaching agents. Typical bleaching agents include ferricyanides; dichromates; organic complex salts of iron(III) or cobalt (III), for example complex salts with aminopolycarboxylic acids such as ethylenediamine tetra-acetic acid, diethylenetriamine penta-acetic acid, cyclohexanediamine tetra-acetic acid, methylimino diacetic acid, 1,3-diaminopropane tetra-actic acid, glycol ether diamine tetra-acetic acid etc. or citric acid, tartaric acid, malic acid etc.; persulfates; bromates; permanganates and nitrobenzenes etc. Of these materials the aminopolycarboxylic acid iron(III) complex salts, principally ethylenediamine tetra-acetic acid iron(III) complex salts, and persulfates, is preferred with respect to rapid processing and the prevention of environmental pollution. Moreover, the aminopolycarboxylic acid iron(III) complex salts are especially useful in both bleach baths and bleach-fix baths. The pH of a bleach or bleach-fix bath in which aminopolycarboxylic acid iron(III) complex salts are being used is normally from 5.5 to 8, but processing can be carried out at lower pH values in order to speed-up processing.

Bleaching accelerators can be used, as required, in the bleach baths, bleach-fix baths, or bleach or bleach-fix pre-baths. Examples of bleach accelerators have been disclosed as follows: Compounds which have a mercapto group or a disulfide group are disclosed in U.S. Pat. No. 3,893,858, West German Patents 1,290,812 and 2,059,988, in JP-A-53-32736, JP-A-53-57831, JP-A-53-A-53-37418, JP-A-53-72623, JP-A-53-95630, JP-A-53-95631, JP-A-53-104232, JP-A-53-124424, JP-A-53-141623 and JP-A-53-28426 and in *Research Disclosure* No. 17129 (Jul. 1978) etc.; the thiazolidine derivatives are disclosed in JP-A-50-140129; the thiourea derivatives are disclosed in JP-B-45-8506, in JP-A-52-20832 and JP-A-53-32735, and in U.S. Pat. No. 3,706,561; the iodides West German Patent 1,127,715 and in JP-A-58-16235; the polyoxyethylene compounds are disclosed in West German Patents 966,410 and 2,748,430; the polyamine compounds are disclosed in JP-B-45-8836; other compounds are disclosed in JP-A-49-42434, JP-A-49-59644, JP-A-53-94927, JP-A-54-35727, JP-A-55-26506 and JP-A-58-163940; and bromide ions etc. Among these compounds, those which have a mercapto group or a disulfide group are preferred in view of their large accelerating effect, and the use of the compounds disclosed in U.S. Pat. No. 3,893,858, in West German Patent 1,290,812, and in JP-A-53-95630 is especially desirable. Moreover, the use of the compounds disclosed in U.S. Pat. No. 4,552,834 is also desiable. Bleach accelerators may be added to the sensitive material. These bleach accelerators are especially effective when bleach-fixing color photosensitive materials are for photographic use.

Thiosulfates, thiocyanates, thioether based compounds, thioureas and large quantities of iodides etc. can be used as fixing agents, but thiosulfates are generally used for this purpose, and ammonium thiosulfate in particular can be used in the widest range of applications. Sulfites or bisulfites, or carbonylbisulfite addition compounds, are preferred preservatives for bleach-fix baths.

The silver halide color photographic materials of this invention are generally subjected to a water washing and/or stabilizing process after the desilvering process. The amount of water used in the water washing process can be fixed within a wide range according to the nature of the photosensitive material (for example, the type of couplers used), the use, the wash water temperature, the number of washing tanks (the number of washing stages), the replenishment system, i.e. whether a counter-flow or a sequential-flow system is used, and various other conditions. The relationship between the amount of water used and the number of water washing tanks in a multi-stage counter-flow system can be obtained using the method outlined on pages 248 to 253 of *Journal of Society of Motion Picture and Television Engineers,* Volume 64 (May 1955).

The amount of wash water can be greatly reduced by using a multi-stage counter-flow system as noted, but bacteria proliferates due to the increased residence time of the water in the tanks. Also, problems arise as a result of sediments which become attached to the photosensitive material. The method in which the calcium ion and manganese ion concentrations are reduced as disclosed in JP-A-62-288838 can be used effectively to overcome problems of this sort in the processing of color photosensitive materials of this invention. Furthermore, the isothiazolone compounds and thiabendazoles disclosed in JP-A-57-8542 and the chlorine based disinfectants such as chlorinated sodium isocyanurate, and benzotriazoles etc., and the disinfectants disclosed in *Chemistry of Biocides and Fungicides* by Horiguchi, *Reduction of Micro-organisms, Biocidal and Fungicidal Techniques,* published by the Health and Hygiene Technical Society and in *A Dictionary of Biocides and Fungicides,* published by the Japanese Biocide and Fungicide Society, can be used for this purpose.

The pH value of the wash water used in the processing of the photosensitive materials of invention is within the range from 4 to 9, and preferably within the range from 5 to 8. The wash water temperature and the washing time are set according to the nature of the photosensitive material and the application etc. but, in general, washing conditions of from 20 seconds to 10 minutes at a temperature of from 15° to 45° C., and preferably of from 30 seconds to 5 minutes at a temperature of from 25° to 40° C., are selected. Moreover, the photosensitive materials of this invention can be processed directly in a stabilizing bath instead of being subjected to a water wash as described above. The methods disclosed in JP-A-57-8543, JP-A-58-14834 and JP-A-60-220345 can be used for this purpose.

Furthermore, a stabilization process can be carried out following the water washing process. Stabilizing baths which contain formalin and a surfactant can be used as a final bath for camera color photosensitive materials. Various chelating agents and fungicides etc. can be added to these stabilizing baths.

The overflow which accompanies replenishment of the above mentioned wash water and/or stabilizer can be re-used in other processes such as the desilvering process etc.

A color developing agent may also be incorporated into the silver halide color photosensitive materials of the present invention in order to simplify and speed-up processing. The incorporation of various color developing agent precursors is preferred. For example, the indoaniline based compounds disclosed in U.S. Pat. No. 3,342,597, the Schiff's base type compounds disclosed in U.S. Pat. No. 3,342,599 and in *Research Disclosure* Nos. 14850 and 15159, the aldol compounds disclosed in *Research Disclosure* No. 13924, the metal salt complexes disclosed in U.S. Pat. No. 3,719,492, and the urethane based compounds disclosed in JP-A-53-135628 can be used for this purpose.

Various 1-phenyl-3-pyrazolidones incorporated, as required, into the silver halide color photosensitive materials of this invention in order to accelerate color development. Typical compounds of this type have been disclosed in JP-A-56-64339, JP-A-57-144547 and JP-A-58-115438 etc.

The various processing baths of the present invention are used at a temperature of from 10° to 50° C. The standard temperature is normally from 33° to 38° C., but processing is accelerated and the processing time is shortened at higher temperatures and, conversely, increased picture quality and improved stability of the processing baths can be achieved at lower temperatures. Furthermore, processes using hydrogen peroxide intensification or cobalt intensification as disclosed in West German Patent 2,226,770 or U.S. Pat. No. 3,674,499 can be carried out in order to economize silver in the photosensitive material.

The present invention will now be described in detail referring to examples and comparative examples. However, the present invention is not to be construed as being limited thereto.

EXAMPLE 1

A multilayer silver halide photosensitive material 101 with the layer structure indicated below, was prepared on a paper support which had been laminated on both sides with polyethylene.

Layer Structure

The composition of each layer is indicated below. The numerical values indicate coated weights (grams per square meter). The amount of silver halide emulsion is given in terms of grams per square meter of silver coated.

Support

Polyethylene Laminated paper.

(A white pigment ($TiO_2$) and ultramarine dye were included in the polyethylene on the same side on which the first layer is to be coated.)

| | |
|---|---|
| First Layer (Blue Sensitive Layer) | |
| Mon-disperse silver chlorobromide emulsion (B-1) | 0.27 |
| Gelatin | 1.86 |
| Tellow coupler (Y-1) | 0.82 |
| Solvent (Solv-1) | 0.35 |
| Second Layer (Anti-color Mixing Layer) | |
| Gelatin | 0.99 |
| Anti-color mixing agent (Cpd-1) | 0.06 |
| Solvent (Solv-2) | 0.12 |
| Third Layer (Green Sensitive Layer) | |
| Mon-disperse silver chlorobromide emulsion (G-1) | 0.45 |
| Gelatin | 1.24 |
| Magenta coupler (M-1) | 0.35 |
| Colored image stabilizer (Cpd-2) | 0.12 |
| Colored image stabilizer (Cpd-3) | 0.06 |
| Colored image stabilizer (Cpd-4) | 0.10 |
| Colored image stabilizer (Cpd-5) | 0.01 |
| Solvent (Solv-2) | 0.25 |
| Solvent (Solv-3) | 0.25 |
| Fourth Layer (Ultraviolet Absorbing Layer) | |
| Gelatin | 1.60 |
| Ultraviolet absorber (Cpd-6/Cpd-7/Cpd-8 = 3/2/6 by weight) | 0.70 |
| Anti-color fading agent (Cpd-1) | 0.05 |
| Solvent (Solv-4) | 0.42 |
| Fifth Layer (Red Sensitive Layer) | |
| Mon-disperse silver chlorobromide emulsion (R-1) | 0.20 |
| Gelatin | 0.92 |
| Supersensitizing agent (Cpd-16) | 0.006 |
| Cyan coupler (C-1) | 0.15 |
| Cyan coupler (C-2) | 0.18 |
| Colored image stabilizer (Cpd-10) | 0.02 |
| Ultraviolet absorber (Cpd-6/Cpd-7/Cpd-9 = 3/4/2 by weight) | 0.17 |
| Solvent (Solv-4) | 0.20 |
| Sixth Layer (Ultraviolet Absorbing Layer) | |
| Gelatin | 0.54 |
| Ultraviolet absorber (Cpd-6/Cpd-7/Cpd-8 = 1/5/3 by weight) | 0.21 |
| Solvent (Solv-4) | 0.08 |
| Seventh Layer (Protective Layer) | |
| Acid treated gelatin | 1.33 |
| Acrylic modified poly(vinyl alcohol) polymer (17% modified) | 0.17 |
| Liquid paraffin | 0.03 |

Furthermore, Cpd-11 and Cpd-12 were used as gantihalation dyes at this time. Moreover, "Alkanol XC"

(made by the Dupont Co. and sold under the trademark "Alkanol XC"), sodium alkylbenzenesulfonate, succinic acid ester and "Megafac F-120" (made by the Dainippon Ink Co. and sold under the trademark "Magafac F-120) were used as emulsification, dispersion and coating promoters in each layer. Cpd-13 and Cpd-14 were used as silver halide stabilizers.

Furthermore, 1-oxy-3,5-dichloro-s-triazine, sodium salt, was used as a gelatin hardening agent in each layer, and Cpd-15 was used as a viscosity increasing agent.

Y-1

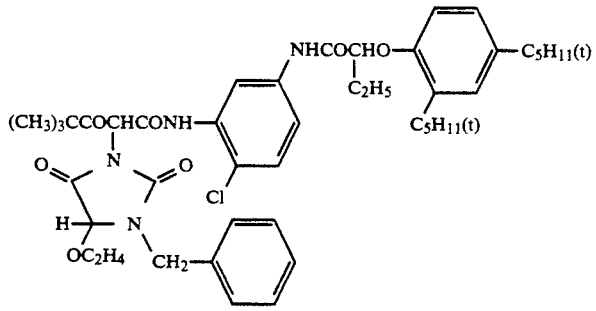

M-1

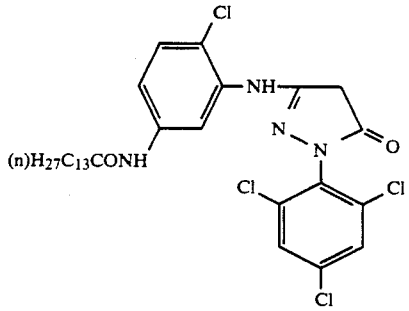

C-1

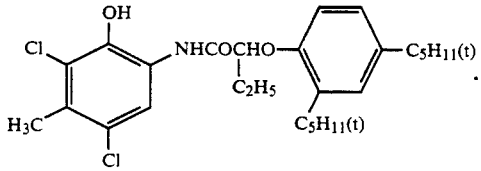

C-2

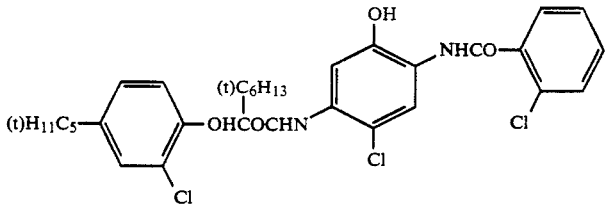

Dibutyl phthalate — Solv-1

Tricresyl phosphate — Solv-2

$(C_4H_9CHCH_2O)_3P{=}O$ (with $C_2H_5$ on the CHCH$_2$O group) — Solv-3

Dioctyl sebacate — Solv-4

Cpd-1

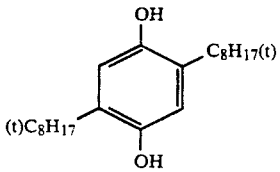

-continued
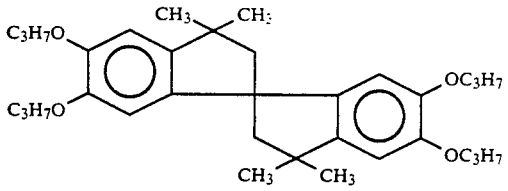
Cpd-2
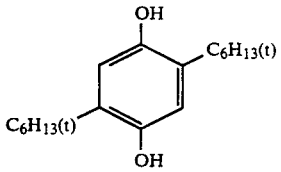
Cpd-3
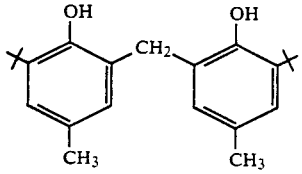
Cpd-4
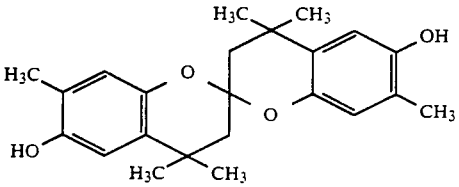
Cpd-5
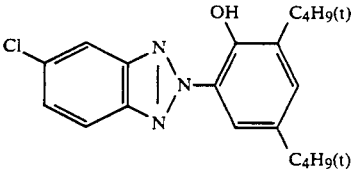
Cpd-6
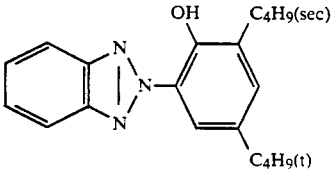
Cpd-7
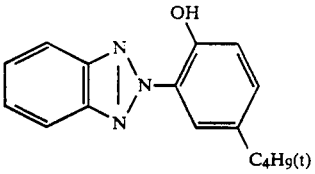
Cpd-8
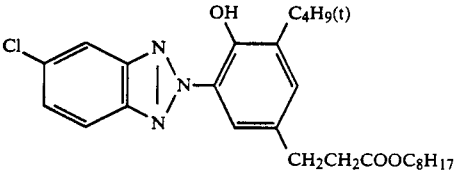
Cpd-9
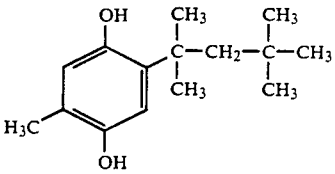
Cpd-10

-continued
Cpd-11
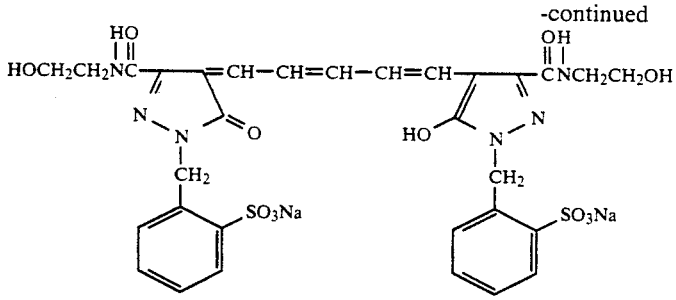
Cpd-12
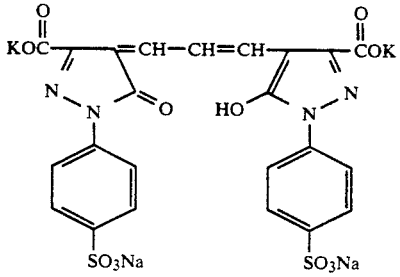
Cpd-13
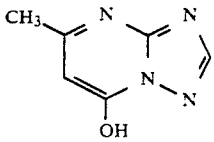
Cpd-14
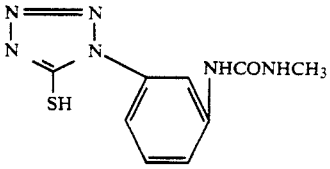
Cpd-15
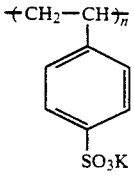
Cpd-16
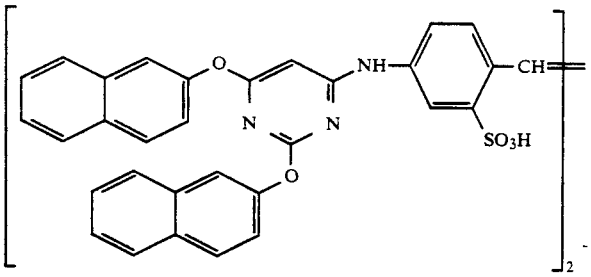
Cpd-17
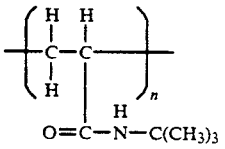
Number Average Molecular Weight 60,000
Glass Transition Temperature ($T_g$) 128° C.

Preparation of the Blue Sensitive Emulsion

Lime treated gelatin (32 grams) was added to 1000 ml of distilled water and, after dissolving at 40° C., 5.8 grams of sodium chloride was added and the temperature was raised to 75° C. N,N'-Dimethylimidazolidin-2-thione (3.8 ml of a 1% aqueous solution) was added to this solution. Next, a solution obtained by dissolving 6.4 grams of silver nitrate in 180 ml of distilled water and a solution obtained by dissolving 2.2 grams of sodium chloride in 180 ml of distilled water were added to, and mixed with, the aforementioned solution over a period of 10 minutes while maintaining the temperature at 75° C. Next, a solution obtained by dissolving 153.6 grams of silver nitrate in 410 ml of distilled water and a solution obtained by dissolving 52.8 grams of sodium chloride in 410 ml of distilled water were added to, and mixed with, the resulting mixture over a period of 35 minutes while maintaining the temperature at 75° C. After the addition of the aqueous silver nitrate and aqueous sodium chloride solutions had been completed, the mixture was maintained at a temperature of 75° C. for a period of 15 minutes and then the temperature was reduced to 40° C. The mixture was then desalted and washed with water. Moreover, lime treated gelatin and 3-{2-[5-chloro-3-(3-sulfonatopropyl)benzothiazolin- 2-ylidenemethyl]-3-naphtho[1,2-d]thiazolio}propanesulfonic acid, triethylammonium salt (172.8 mg) ware then added to form emulsion (B).

Triethylthiourea was added to emulsion (B) and this was subjected to optimal chemical sensitization to provide the emulsion (B-1).

A 0.05 μ silver bromide fine grained emulsion (1) was added in the amount of 0.6 mol. % with respect to the aforementioned emulsion (B), more triethylthiourea was added, and the mixture was subjected to optimal chemical sensitization to provide the emulsion (B-2).

The compound S indicated below was added as a stabilizer in an amount of 90 mg per mol of silver halide in the emulsion to both emulsions (B-1) and (B-2).

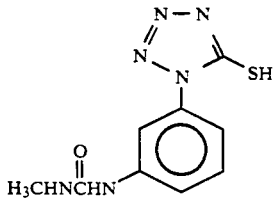

Preparation of the Green Sensitive Emulsion

Lime treated gelatin (32 grams) was added to 1000 ml of distilled water and, dissolving at 40° C., 3.3 grams of sodium chloride was added and the temperature was raised to 52° C. N,N'-Dimethylimidazolidin-2-thione (3.2 ml of a 1% aqueous solution) was added to this solution. Next, a solution obtained by dissolving 32.0 grams of silver nitrate in 200 ml of distilled water and a solution obtained by dissolving 11.0 grams of sodium chloride in 200 ml of distilled water were added to, and mixed with, the aforementioned solution over a period of 14 minutes while maintaining the temperature at 52° C. Next, a solution obtained by dissolving 128.0 grams of silver nitrate in 560 ml of distilled water and a solution obtained by dissolving 44.0 grams of sodium chloride in 560 ml of distilled water were added to, and mixed with, the resulting mixture over a period of 20 minutes while maintaining the temperature at 52° C. 2-[5-Phenyl-2-{2-[5-phenyl-3-(2-sulfonatoethyl)benzoxazolin-2-ylidenemethyl]-1-butenyl}-3-benzoxazolio]ethanesulfonic acid, pyridinium salt, (286.7 mg) was added 1 minute after the addition of the aqueous silver nitrate and aqueous sodium chloride solutions had been completed. After maintaining the mixture at a temperature of 52° C. for a further period of 15 minutes, the temperature was reduced to 40° C. and the mixture was desalted and washed with water. Moreover, lime treated gelatin was added to form the un-chemically sensitized emulsion, emulsion (G).

Triethylthiourea was added to emulsion (G) and this was subjected to optimal chemical sensitization to provide the emulsion (G-1).

A 0.05 μ silver bromide fine grained emulsion (1) was added at the rate of 1 mol. % with respect to the aforementioned emulsion (G), more triethylthiourea was added and the mixture was subjected to optimal chemical sensitization to provide the emulsion (G-2).

The aforementioned compound S was added as stabilizer in an amount of 125 mg per mol of silver halide in the emulsion to both the emulsions (G-1) and (G-2).

Preparation of the Red Sensitive Emulsion

2-[2,4-(2,2-dimethyl-1,3-propano)-5-(6-methyl-3-pentylbenzothiazolin-2-ylidene)-1,3-pentadienyl]-3-ethyl-6-methylbenzothiazolium iodide (60 mg) was added in place of the 2-[5-phenyl-2-{2-[5-phenyl-3-(2-sulfonatoethyl)benzoxazolin-2-ylidenemethyl]-1-butenyl}-3-benzoxazolio]ethanesulfonic acid, pyridinium salt, (286.7 mg) in the green sensitive emulsions (G-1) and (G-2) and optimization was carried out in each case to form the red sensitive emulsions (R-1) and (R-2).

The aforementioned stabilizer S was added in the same manner as for the emulsions (G-1) and (G-2).

The form of the grains, the grain sizes and the grain size distributions of the silver halide emulsions (B-1) to (R-2) obtained were defermined by electron micrographs. The silver halide grains in the emulsions (B-1) to (R-2) were all of a cubic form. The grain size was represented by the average value of the diameter of the circles which had the same areas as the projected areas of the grains, and the grain size distribution was indicated using the value obtained on dividing the standard deviation of the grain size by the average grain size (i.e. the variation coefficient).

Next, X-ray diffraction measurements were made in order to determine the halogen compositions of the local phases of the grains.

The results obtained were as shown in Table 1.

TABLE 1

| Emulsion | Halogen Composition of Local Phase by X-Ray Diffraction | Average Grain Size (μ) | Crystal Form | Size Distribution *1 |
|---|---|---|---|---|
| (B-1) | None | 1.1 | Cubic | 0.07 |
| (B-2) | AgBr = 0 to 30 mol % | 1.1 | Cubic | 0.07 |
| (G-1) | None | 0.51 | Cubic | 0.08 |
| (G-2) | AgBr = 0 to 40 mol % | 0.51 | Cubic | 0.08 |
| (R-1) | None | 0.51 | Cubic | 0.08 |
| (R-2) | AgBr = 0 to 50 mol % | 0.51 | Cubic | 0.08 |

*1: Variation coefficient

The photosensitive materials 102 to 107 of which the structures are indicated in Table 2 were prepared in the same way.

TABLE 2

| Sample | Emulsion | Cyan Coupler | Other Features |
|---|---|---|---|
| 101 | (B-1), (G-1), (R-1) | C-1/C-2 | — |
| 102 | As Above | C-2, equimolar with (101) | — |
| 103 | As Above | C-1, equimolar with (101) | — |
| 104 | As Above | As Above | 0.33 g/m$^2$ of Cpd-17 in red sensitive Layer** |
| 105 | As Above | As Above | As Above, and ethyl acetate removed from coupler dispersion until present in an amount of ½ by weight with respect to the coupler*** |
| 106 | As Above | As Above | As Above, and ethyl acetate removed from coupler dispersion until present in an amount of 1/10 by weight with respect to the coupler |
| 107 | (B-2), (G-2), (R-2) | As Above | As Above |

*The other features listed in corresponding portion of the Table are points differing from sample 101.

**The cyan coupler dispersion containing Cpd-17 of the present invention was prepared as the following manner: A solution contianing 5 g of cyan coupler (C-1), 6 g of cyan coupler (C-2), 11 g of Cpd-17, 6.7 g of coupler solvent (Solv-4), 0.67 g of colored image stabilizer (Cpd-10), 5.7 g of a mixture of ultraviolet absorber (Cpd-6/Cpd-7/Cpd-9 = 3/4/2) and 12 ml of ethyl acetate was heated to 50° C., and the solution was added to 100 ml of an aqueous solution containing 15 g of gelatin and 1.0 g of sodium dodecylbenzensulfonate. The obtained mixture was stirred by a high speed stirrer (a homegenizer of Nippon Seiki Mfg. Co., Ltd.) to obtain a fine grain emulsified dispersion.

***The removal of the ethyl acetate was achieved by evaporation by dissolving the emulsified dispersion at 40° C. and leaving the mixture to stand, with stirring, at room temperature. The content was determined by gas chromatography.

Stability of Unexposed Film

The color photosensitive materials obtained in this way were stored for 24 hours at 40° C., 70% relative humidity, to provide samples which had been hardened to the prescribed film strength. On the other hand, a portion of the samples which had been hardened were taken and stored for an additional 7 days at 40° C., 80% relative humidity.

The samples obtained were gradewise exposed for sensitometry through a red filter using an enlarger (made by the Fuji Photo Film Co., Ltd., with a Fujicolor 690 Head). The samples were then developed in accordance with the processing operations indicated below.

Additional samples were coated, using coating liquids of the same compositions as used for samples 101 to 107, with the exception that these coating liquids were allowed to stored for 8 hours at 40° C. before coating. These samples were processed in the same manner as samples 101 to 107. The speeds of the new samples were then compared with those of the samples 101 to 107.

The results obtained are shown in Table 3.

After exposure through an optical wedge, the above mentioned photosensitive materials were processed using the processing operations indicated below.

| Processing Operation | Temperature | Time |
|---|---|---|
| Color development | 35° C. | 45 seconds |
| Bleach-fix | 30 to 36° C. | 45 seconds |
| Stabilization (1) | 30 to 37° C. | 20 seconds |
| Stabilization (2) | 30 to 37° C. | 20 seconds |
| Stabilization (3) | 30 to 37° C. | 20 seconds |
| Stabilization (4) | 30 to 37° C. | 30 seconds |
| Drying | 70 to 85° C. | 60 seconds |

(Four tank counter-flow system from stabilization (4) to stabilization tank (1).)

The composition of each of the processing baths was as indicated below.

| | |
|---|---|
| Color Development Bath | |
| Water | 800 ml |
| Ethylenediamine tetra-acetic acid | 2.0 grams |
| Triethanolamine | 8.0 grams |
| Sodium chloride | 1.4 grams |
| Potassium carbonate | 25 grams |
| N-Ethyl-N-(β-methanesulfonamido-ethyl)-3-methyl-4-aminoaniline sulfate | 4.2 grams |
| N,N-diethylhydroxylamine | 4.2 grams |
| 5,6-Dihydroxybenzene-1,2,4-trisulfonic acid | 0.3 grams |
| Fluorescent whitener (4,4'-Diamino-stilbene based) | 2.0 grams |
| Water to make up to | 1000 ml |
| pH (25° C.) | 10.10 |
| Bleach Fix Bath | |
| Water | 400 ml |
| Ammonium thiosulfate (70%) | 100 ml |
| Sodium sulfite | 18 grams |
| Ethylenediamine tetra-acetic acid iron(III) ammonium salt | 55 grams |
| Ethylenediamine tetra-acetic acid disodium salt | 3 grams |
| Glacial acetic acid | 8 grams |
| Water to make up to | 1000 ml |
| pH (25° C.) | 5.5 |
| Stabilizer Bath | |
| Formalin (37%) | 0.1 gram |
| Formalin/sulfurous acid adduct | 0.7 gram |
| 5-Chloro-2-methyl-4-isothiazolin-3-one | 0.02 gram |
| 2-Methyl-4-isothiazolin-3-one | 0.01 gram |
| Copper sulfate | 0.005 gram |
| Water to make up to | 1000 ml |
| pH (25° C.) | 4.0 |

TABLE 3

| Sample | Speed* | Speed after Storing Coating Liquid for 8 hours at 40° C. prior to application* | Speed after Storing Photographic material for 7 days at 40° C. 80% RH following application** | Remarks |
|---|---|---|---|---|
| 101 | 100 | 76 | 62 | Comparative Example |
| 102 | 93 | 73 | 59 | Comparative Example |
| 103 | 105 | 77 | 63 | Comparative Example |
| 104 | 115 | 82 | 67 | Invention |
| 105 | 116 | 91 | 66 | Invention |
| 106 | 118 | 95 | 67 | Invention |
| 107 | 381 | 98 | 73 | Invention |

*Relative speed when the speed of sample 101 is taken to be 100.

**Relative speed when the speed prior storage of the same material is taken to be 100.

It is clear from the result shown in Table 3 that the samples which contained Cpd-17, a polymer of this invention, retained high speed and that they were superior to the comparative materials in respect of both the storage of the coating liquid and the storage of the color sensitive materials.

Moreover, the samples 105 and 106 from which the low boiling solvent had been removed exhibited a remarkably small loss of speed on storing of the coating liquid.

Moreover, the silver chlorobromide emulsions (sample 107) which had a local silver bromide rich phase obtained by adding a fine grain silver bromide emulsion and ripening the mixture had a high speed and was excellent in respect of both the storage properties of the coating liquid and the wet storage properties of the photosensitive material. A similar effect was observed on using the polymers P-3, P-21, P-29, P-30 and P-110 in place of Cpd-17. The same result was obtained on using a pyrazoloazole type coupler (M-3) in place of 5-pyrazolone type coupler as a magenta coupler.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer containing a substantially iodide free silver chlorobromide or silver chloride grain of which the silver chloride content is at least 90 mol. % and a color coupler, wherein said color coupler which is contained in said emulsion layer is at least one compound represented by general formula (I) and/or (II), and wherein said coupler is dispersed in said emulsion layer, as a dispersion of a fine lipophilic particle obtained by emulsification and dispersion of a solution obtained by dissolution of (a) said coupler together with (b) at least one homopolymer or copolymer which is insoluble in water and soluble in an organic solvent and (c) a high boiling point organic solvent:

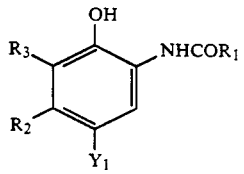

(I)

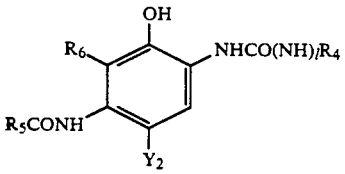

(II)

wherein in formula (I) and (II), $R_1$, $R_4$, and $R_5$ represent substituted or unsubstituted aliphatic, aromatic or heterocyclic groups; $R_3$ and $R_6$ each represents a hydrogen atom, a halogen atom, an aliphatic group, an aromatic group or an acylamino group, or $R_6$ represents a group of non-metal atoms required to form, together with $R_5$, a five or six membered nitrogen containing ring; $R_2$ represents an aliphatic group which may be substituted; $Y_1$ and $Y_2$ each represents a hydrogen atom or a group which can be eliminated during a coupling reaction with the oxidized form of a developing agent; and l represents the integer 0 or 1, or wherein polymeric couplers consisting of dimers or greater units can be formed via one group selected from among $R_2$, $R_3$, and $Y_1$ or one group selected from among $R_5$, $R_6$, and $Y_2$.

2. A silver halide color photographic material as in claim 1, wherein the silver halide grains contained in the emulsion layer of said photographic material are spectrally sensitized with at least one sensitizing dye represented by formulae (III), (IV), or (V); and wherein said dispersion consists of said color coupler, said high boiling point organic solvent, a low boiling point or water soluble organic solvent and said at least one water insoluble and organic solvent soluble homo- or co-polymer; and wherein said dispersion is mixed with said silver halide grain after removing said low boiling point or water soluble organic solvent in the emulsification and dispersion process until the ratio by weight with respect to the coupler becomes not more than ½ to prepare a coating liquid:

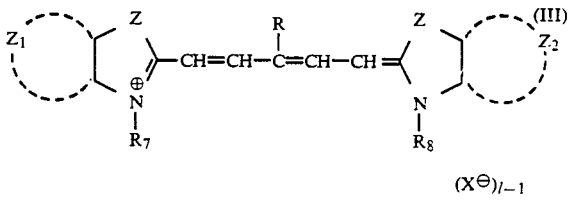

(III)

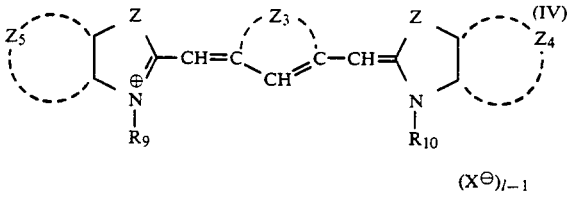

(IV)

wherein R represents a hydrogen atom or an alkyl group; $R_7$ to $R_{10}$ each represents an alkyl group or an aryl group; $Z_1$, $Z_2$, $Z_4$ and $Z_5$ each represents a group of atoms required to form a benzene ring or a naphthalene ring; $Z_3$ represents a group of carbon atoms forming a six membered ring; l represents the integer 1 or 2; and Z represents a sulfur atom or a selenium atom wherein the two Z atoms may be the same or different and wherein $X^{\ominus}$ represents an anion:

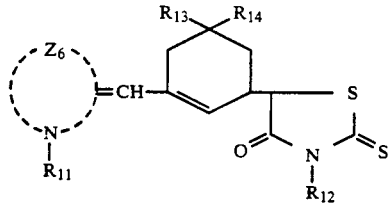

(V)

wherein $R_{11}$ and $R_{12}$ each represents an alkyl group, an aryl group or an allyl group and at least one of $R_{11}$ and $R_{12}$ represents an alkyl group which contains a sulfo group or an alkyl group which contains a carboxyl group; $R_{13}$ and $R_{14}$ each represents alkyl groups; and $Z_6$ represents a group of non-metallic atoms to form a five or six membered nitrogen containing heterocyclic ring.

3. A silver halide color photographic material as in claim 2, wherein the silver halide grains contained in said emulsion layer have a silver bromide rich phase either at the surface or within said grains.

4. A silver halide color photographic material as in claim 1, wherein the silver halide grains contained in said emulsion layer have a silver bromide rich phase either at the surface or within said grains.

5. A silver halide color photographic material as claimed in claim 3, wherein said silver bromide rich phase is present at the surface of the grains.

6. A silver halide color photographic material as claimed in claim 5, wherein said silver bromide rich phase is locally present in the vicinity of the apices of the grains.

7. A silver halide color photographic material as in claim 1, wherein said polymer has a glass transition temperature of not less than 90° C.

8. A silver halide color photographic material as in claim 1, wherein said polymer has a molecular weight not exceeding 100,000.

* * * * *